US008539764B2

(12) United States Patent
Howard

(10) Patent No.: US 8,539,764 B2
(45) Date of Patent: Sep. 24, 2013

(54) CONFIGURATIONS OF A STIRLING ENGINE AND HEAT PUMP

(75) Inventors: Michael Howard, Maxwell, IN (US); Jeremiah J. Haler, legal representative, Anderson, IN (US)

(73) Assignee: Jeremiah Haler, Anderson, IN (US)

( * ) Notice: Subject to any disclaimer, the term of this patent is extended or adjusted under 35 U.S.C. 154(b) by 408 days.

(21) Appl. No.: 12/875,127

(22) Filed: Sep. 3, 2010

(65) Prior Publication Data

US 2011/0088386 A1 Apr. 21, 2011

Related U.S. Application Data

(60) Provisional application No. 61/239,559, filed on Sep. 3, 2009.

(51) Int. Cl.
*F02G 1/04* (2006.01)

(52) U.S. Cl.
USPC ..... 60/525; 60/526

(58) Field of Classification Search
USPC ..... 60/525, 526, 517; 123/68, 69, 70 R, 123/72, 543, 90.31, 90.15–90.18
See application file for complete search history.

(56) References Cited

U.S. PATENT DOCUMENTS 4,255,929 A * 3/1981 Frosch et al. ..... 60/517
5,081,963 A * 1/1992 Galbraith ..... 123/58.9
7,076,941 B1 * 7/2006 Hoffman et al. ..... 60/643

* cited by examiner

*Primary Examiner* — Thomas Denion
*Assistant Examiner* — Shafiq Mian
(74) *Attorney, Agent, or Firm* — Brian Asquith

(57) ABSTRACT

A configuration of heat engine, a stirling engine, is presented that utilizes an even number of axially opposed, axially aligned cylinders and that can be made using almost unlimited variations in the number of cylinder pairings, size, length, operating temperatures and pressures, materials, heating and cooling sources, etc. The axially opposed configuration of the cylinder pairs maximizes engine efficiency by minimizing dead space, maximizing thermal isolation of the hot and cold sides, maximizing regenerator efficiency, maximizing the free flow of the working fluid and allowing the engine speed (rpm) and power output to be rapidly and precisely altered and controlled. When driven, the engine acts as a heat pump, with all of the aforementioned improvements and advantages over previous kinematic heat pumps and wherein the piston timing can be varied for precise temperature control and to provide a method of defrosting that requires no additional parts or heat source.

20 Claims, 16 Drawing Sheets

CONFIGURATIONS OF A STIRLING ENGINE AND HEAT PUMP

CROSS-REFERENCE TO RELATED APPLICATIONS

This application claims the benefit of U.S. Provisional Application Ser. No. 61/239,559, filed on Sep. 3, 2009, entitled "DELTA CONFIGURED STIRLING ENGINE AND HEAT PUMP". The entirety of the above-captioned application is incorporated herein by reference.

BACKGROUND

A Stirling engine is a type of heat engine that operates based upon the expansion and contraction of a working gas (e.g., air, helium, hydrogen, etc.) contained in side the working spaces of the engine, where the working spaces comprise a hot workspace and a cold workspace, with a regenerator between them. As the working gas moves into the hot space, it expands, diving the pistons apart, it is then transferred to the cold space where it contracts and fly wheel energy is used to further compress it. The working gas is then transferred back to the hot mace and the cycle repeats.

Numerous Stirling engine designs have been developed and recently interest in Stirling engines has been renewed owing to such factors as the ability to power a Stirling engine with a renewable energy source(s), their quiet operation, and low vibration characteristics.

Three primary configurations commonly known as alpha, beta and gamma Stirling engines have been developed. While many improvements have been made regarding the efficiency of such engines substantial research and development is ongoing to address such concerns as size, cost, power, torque, variable speed, etc.

SUMMARY

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form as a prelude to the more detailed description that is disclosed later.

Various Stirling engine configurations are presented comprising of single or multiple pairs of hot and cold side cylinders axially opposed to each other. Each pair of cylinders comprise a cylinder having an internal hot working mace and a cylinder having an internal cold working space where the cylinders are axially aligned. Each cylinder contains a piston which reciprocates along a length of the cylinder and owing to the alignment of the cylinders, the pistons are axially opposed. One or more regenerators separate the hot working space of one cylinder from the cold working space of the other. A working gas is transferred between the hot working mace and the cold working space imparting reciprocating movement of the pistons.

The various engine configurations can comprise connecting rods connecting the pistons to crankshafts, where the crankshaft attached to one of the pistons in the piston pairings is a separate crankshaft from that connected to the other piston.

In a further aspect, one or more heating components can be located between the regenerator and hot side cylinder, and one or more cooling components can be located between the regenerator and the cold side cylinder to facilitate respective heating and cooling. A computer, processor, or the like can be employed to facilitate control of the respective heating or cooling operation(s).

In another aspect, the operating surface of a regenerator, a bore of the heating component, a bore of the cooling component, the bore diameter of the hot side cylinder and the bore diameter of the cold side cylinder can have the same diameter maximizing free flow of the working gas between the hot and cold working spaces through are generator(s), heater(s), and cooler(s), for maximum engine efficiency and power output.

In another aspect, operation of the engine configuration can be throttled Timing pulleys can be located on the ends of the crankshafts and a timing belt employed to couple the timing pulleys/crankshafts. A slide mechanism including a slide and idler pulleys can be located on the timing belt between the timing pulleys. Adjusting the position of the slide mechanism up and down adjusts the relationship between the timing pulleys, with rotation of the crank shafts and reciprocating motion of the pistons being altered. As the position of the slice is altered the relationship of the timing pulleys is altered, causing the phase relation between the crankshafts to be altered, and accordingly the position and timing of pistons is affected, allowing control over the efficiency of the engine. In effect, movement of the slide mechanism up and down alters the timing of the crankshafts and can vary engine power output in a rapid and precise manner. Further, movement of the slider mechanism up and down also facilitates compression braking if moved to one extremity of the travel of the slide in direction Z, and/or alto wing the engine to coast if the slider mechanism is moved to the other extremity of the travel of the slide, making rapid and precise changes in engine speed (rpm), coasting and compression braking possible.

In another aspect, a plurality of cylinder pairing configuration scan be utilized. Also the cylinder pairings can be scalable, stackable, and customizable for maximum engine efficiency and power output.

In another aspect a variety of energy soirees can be employed to dive an engine inducing solar, heat, wood stoves and furnaces, other solid-fuel stoves and furnaces, waste heat sources, sewage, manure, trash, heat escaping from lava, and the like.

In another aspect systems for capturing light and converting the light energy into heat energy is presented. In another aspect a system for capturing heat from a remote heat source is presented.

DETAILED DESCRIPTION

Various aspects are now described with reference to the drawings. In the following description, for purposes of explanation, numerous specific details are set forth in order to provide a thorough understanding of one or more aspects. It may be evident, however, that the various aspects may be practiced without these specific details. In other instances, well-known structures and devices are shown in block diagram form in order to facilitate describing these aspects.

To the accomplishment of the foregoing and related ends, one or more examples comprise the features hereinafter fully described and particularly pointed out in the claims. The following description and the annexed drawing set forth in detail certain illustrative aspects and are indicative of but a few of the various ways in which the principles of the various aspects may be employed. Other advantages and novel features will become apparent from the following detailed description when considered in conjunction with the drawings and the disclosed examples are intended to include all such aspects and their equivalents.

Figure 1:
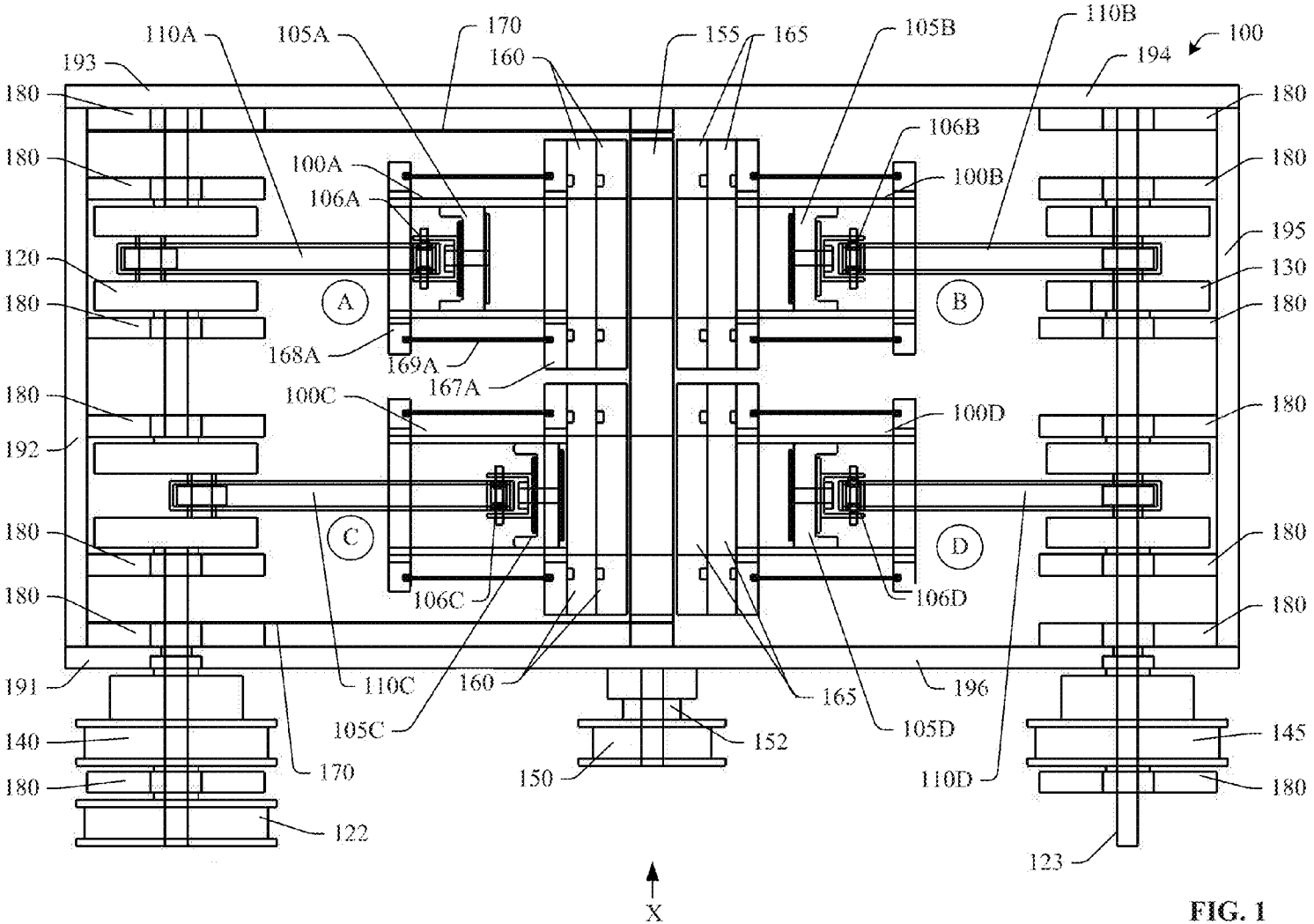
FIG. 1 illustrates an axially opposed engine configuration, according to an aspect.
Figure 2:
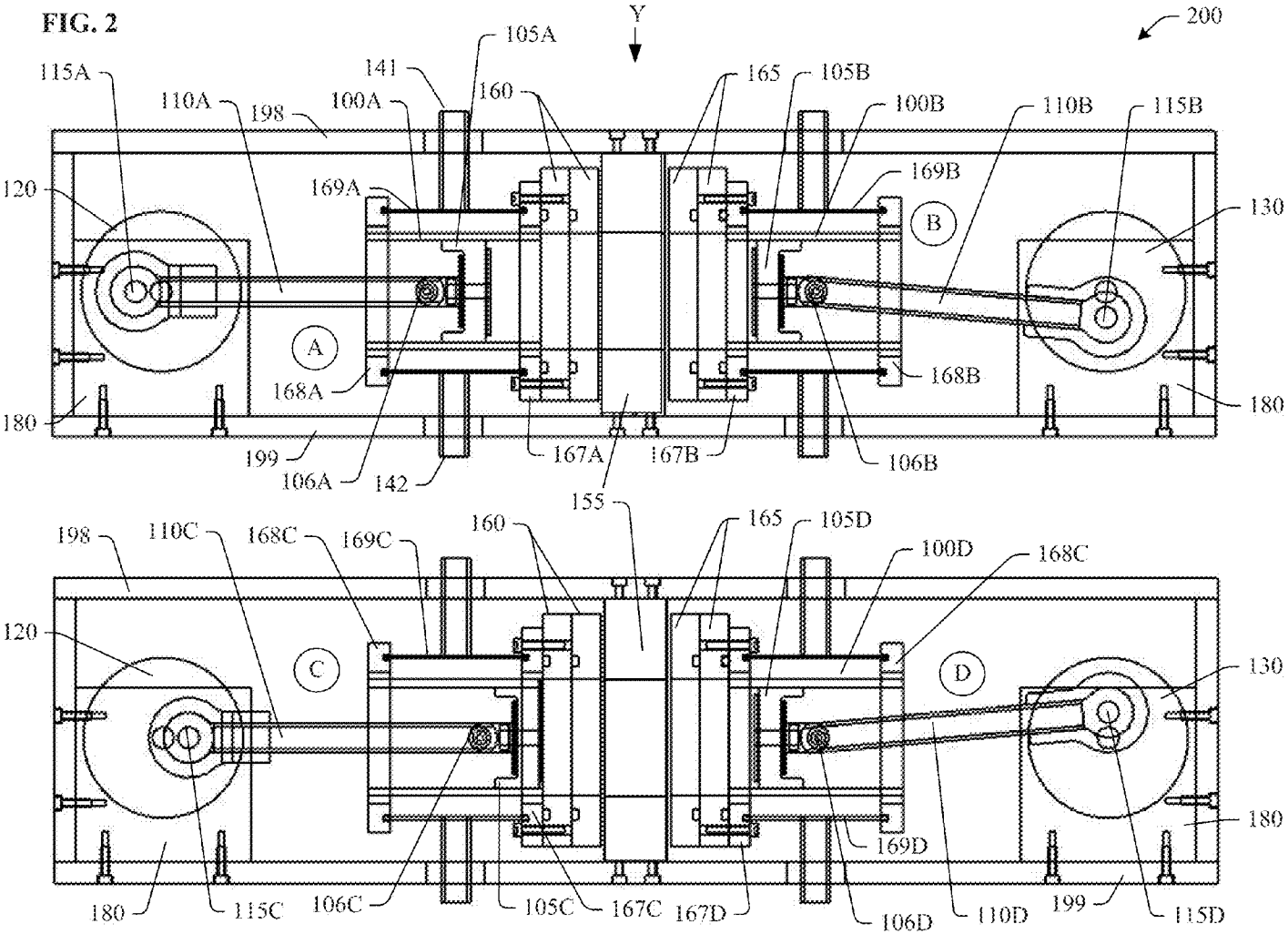
FIG. 2 illustrates an axially opposed engine configuration, according to an aspect.

Referring initially to FIGS. 1 and 2, systems 100 and 200 illustrate a top view (FIG. 1) and a side view (FIG. 2) of an engine configuration comprising four piston assemblies A, B, C, and D. FIG. 2 is a side view in the direction X of FIG. 1, and FIG. 1 is a top view of FIG. 2 in the direction Y.

Figure 11:
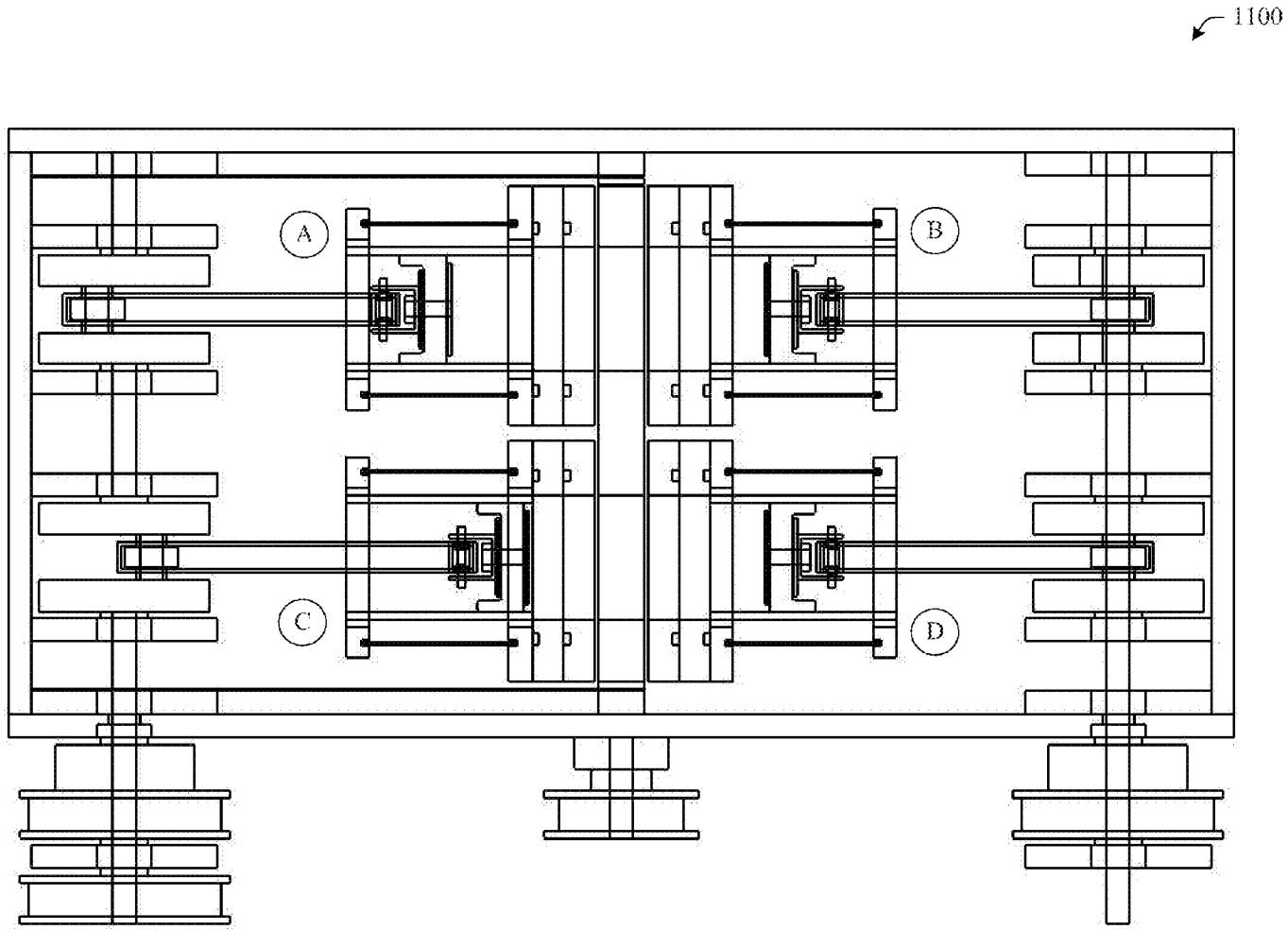
FIG. 11 illustrates an axially opposed engine configuration, according to an aspect.
Figure 12:
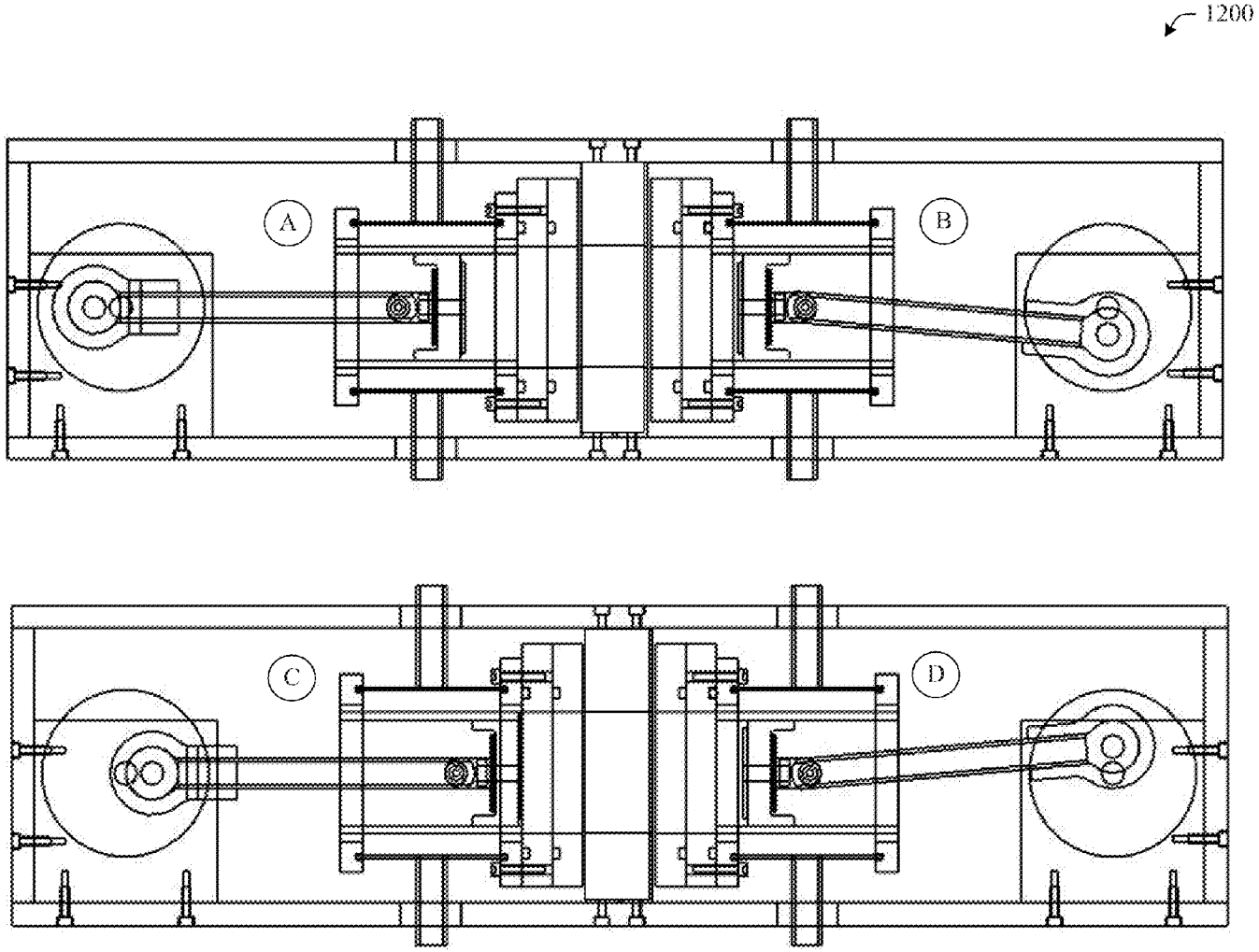
FIG. 12 illustrates an axially opposed engine configuration, according to an aspect.

To enable better understanding of the various aspects disclosed herein, FIGS. 1 and 2 are also presented in FIGS. 11 and 12, where FIGS. 11 and 12 present comparable configurations to those presented in FIGS. 1 and 2, but without the various components marked.

As shown in FIGS. 1 and 2, piston assembly A is coupled to piston assembly C (via crankshaft 120) with the respective piston (pistons 105A and 105C) being about one hundred and eighty degrees out of phase, and piston assembly Bis coupled to piston assembly D (via crankshaft 130) with the respective piston (pistons 105B and 105D) being about one hundred and eighty degrees out of phase.

Further, piston assemblies A and C, and B and D are externally coupled via an adjustable crank shaft timing system comprising timing pulleys 140 and 145, and slide mechanism comprising timing pulley 150 (and slide 152), which are connected by a timing belt (not show)), the adjustable crankshaft timing system is further described with reference to FIGS. 4 and 5, supra. As shown in FIGS. 1 and 2, the crankshaft timing system facilitates the crankshaft assemblies associated with piston assemblies A and C, and B and D to be about ninety degrees (90° out of phase.

Each piston assembly A, B, C, and D, includes a number of common components as follows. A cylinder 100A-D inside of which reciprocates a piston 105A-D. Each piston 105A-D is coup led to a connecting rod 110 A-D via a connecting rod pivot assembly 106A-D, with the connecting rod 110 A-D further coupled to a crankshaft 120 or 130, via crankshaft pins 115A-D. As shown in FIGS. 1 and 2, as a respective piston 105A-D reciprocates tack and forth inside a respective cylinder, the movement of the piston is transferred by the connecting rod to the crankshaft, and the position of the crankshaft is directly related to the position of the piston attached thereto. For example, piston assembly A has piston 105A at the bottom dead center of its stroke, where piston 105A is at its furthest left position while piston 105B is at midstroke, illustrating the 90° phase relationship of the piston assemblies A and B, and the relationship between the piston posit ions and the crankshaft positions. Piston assembly C, on the otherhand, has piston 105C at the top dead center of its stroke, where the piston is at its furthest right position along with the connecting rod attachment pin and crank pin 115C of crankshaft 120. Piston assemblies B and D are at a respective mid-point of their stroke, though moving in opposite directions, illustrating the 90° out of phase relationship with piston assemblies A and C.

Any suitable material can be employed to construct cylinders 100A-D. In one aspect, boro silicate glass can be employed to construct cylinders 100A-D.

Further, in another aspect, any suitable material can be employed to construct pistons 105A-D. It is to be appreciated that while not shown, to facilitate both movement of a piston (e.g., pistons 105A-D) within a cylinder (e.g., cylinders 100A-D) and sealing of a gas within a cylinder, each piston can comprise a piston ring(s), sealing ring(s), and/or rider band(s) assemblies. In one aspect, the pistons can be made from graphite. In another aspect, the pistons can have a profile such that a cylinder is so closely fitting to its respective cylinder bore so as to eliminate the need for a piston ring(s), sealing ring(s) and the like.

To facilitate operation of systems 100 and 200, temperature differentials have to be established in the piston assembly pairings A and B, and C and D, where one of the cylinders in the pairings is heated and one of the cylinders in the pairings is cooled. For example, cylinders 100A and 100C can be heated and cylinders 100B and 100D can be cooled. Along with heating cylinders 100A and 100*c* heating blocks 160 can be utilized to facilitate heating of the working gas in cylinders 100A and 100C. In an aspect heating blocks 160 can be constructed from aluminum, stainless steel, or other material having suitable physical properties to facilitate heating of the working gas in cylinders 100A and 100C. In another aspect, cylinders 100B and 100D can be cooled, where along with external cool ing of the cylinders 100B and 100D, cooling blocks 165 can be utilized to facilitate cooling of the working gas in cylinders 100B and 100D. In an aspect the cooling blocks 165 can be constructed from aluminum, stainless steel, or other material having suitable physical properties to facilitate cooling of the working gas in cylinders 100B and 100D. It is to be appreciated that while FIGS. 1 and 2 illustrate two heating blocks 160 or cooling blocks 165 being employed on a respective piston assembly A, B, C, and D, any number of blocks can be utilized.

As discussed above, piston assemblies A and C are being heated, and piston assemblies B and D are being cooled, accordingly, piston assemblies A and C can be referred to as being hot workspaces and piston assemblies B and D can be referred to as cold workspaces. In particular, the hot workspace of piston assembly A is the volume created between cylinder 100A, piston 105A, and the associated heating block (s) 160 and regenerator(s) 155 (as discussed below). Correspondingly, the hot workspace of piston assembly C is the volume created bet we en cylinder 100C, piston 105C, and the associated heating block(s) 160 and regenerator(s) 155. Accordingly, the cold workspace of piston assembly B is the volume created between cylinder 100B, piston 105B, and the associated cooling block(s) 165 and regenerator(s) 155. Further, the cold work space of piston assembly D is the volume created between cylinder 100D, piston 105D, and the associated cooling block(s) 165 and regenerator(s) 155.

Further, with reference to FIG. 2, each cylinder 100A-D can be mounted inside metal tubing, creating tanks 169 A-D, that surround the cylinders 100A-D and containing a liquid heat transfer medium or liquid coolant on the hot (assemblies A and C) and cold sides (assemblies B and D) respectively. Tanks 169 Å-D can be mounted in grooves cut into the outer tank/cylinder mounts 168A-D and the inner tank/cylinder mounts 167A-D using high-temperature gaskets or high-temperature adhesive and fixed in place concentric to cylinders 100A-D and the assembly, comprised of outer tank/cylinder mount 168A-D, inner tank/cylinder mount 167A-D, tank 169A-D and cylinders 100A-D is mounted in intimate physical contact with the respective heat ing or cooling blocks 160 or 165, on their respective sides, to facilitate heat transfer to their respective heating or cooling blocks 160 and 165. In a further aspect, inner tank/cylinder mounts 167 A-D can be sealed against their respective heating or cooling blocks 160 or 165 by O-rings housed in grooves ca into the outer faces of the heating and cooling blocks 160 and 165, to contain the working fps inside of the engine. It is to be appreciated that the O-rings used to seal heating and cooling blocks 160 and 165 to each other and their associated components, could be replaced by many other forms of static seal or high-temperature adhesive.

In a father aspect, cylinders 100A-D can be located concentrically inside the tanks 169A-D by the use of high-temperature flexible high-temperature adhesive or flexible high-temperature grommets, to allow for differing thermal expansion rates of the various components.

In a father aspect, sealing between the regenerator(s) 155 and the heating and cooling blocks 160 and 165 is achieved using high-temperature gaskets or high-temperature adhesive.

In a father aspect, the assembly comprised of outer tank/cylinder mount 168A-D, inner tank/cylinder mount 167A-D, and tank 169A-D can be made the same length as the cylinders 100A-D or slightly shorter, to facilitate a fillet of adhesive or a grommet lip, extending beyond outer tank/cylinder mount 168A-D.

In another aspect, as shown on FIG. 2, pipes 141 and 142 are attached to tank 169. Pipes 141 and 142 facilitate the circulation of a heating medium for the hot workspace assemblies A and C (or with the cold workspace assemblies C and D, circulation of a cooling medium) to facilitate heating (e.g., by circulating hot oil) or cooling (e.g., by circulating coolant). It is to be appreciated that while pipes 141 and 142 are only shown connected to tank 169A, corresponding pipes are attached to tanks 169B-D but are not labeled, to facilitate readability of FIG. 2.

Figure 3:
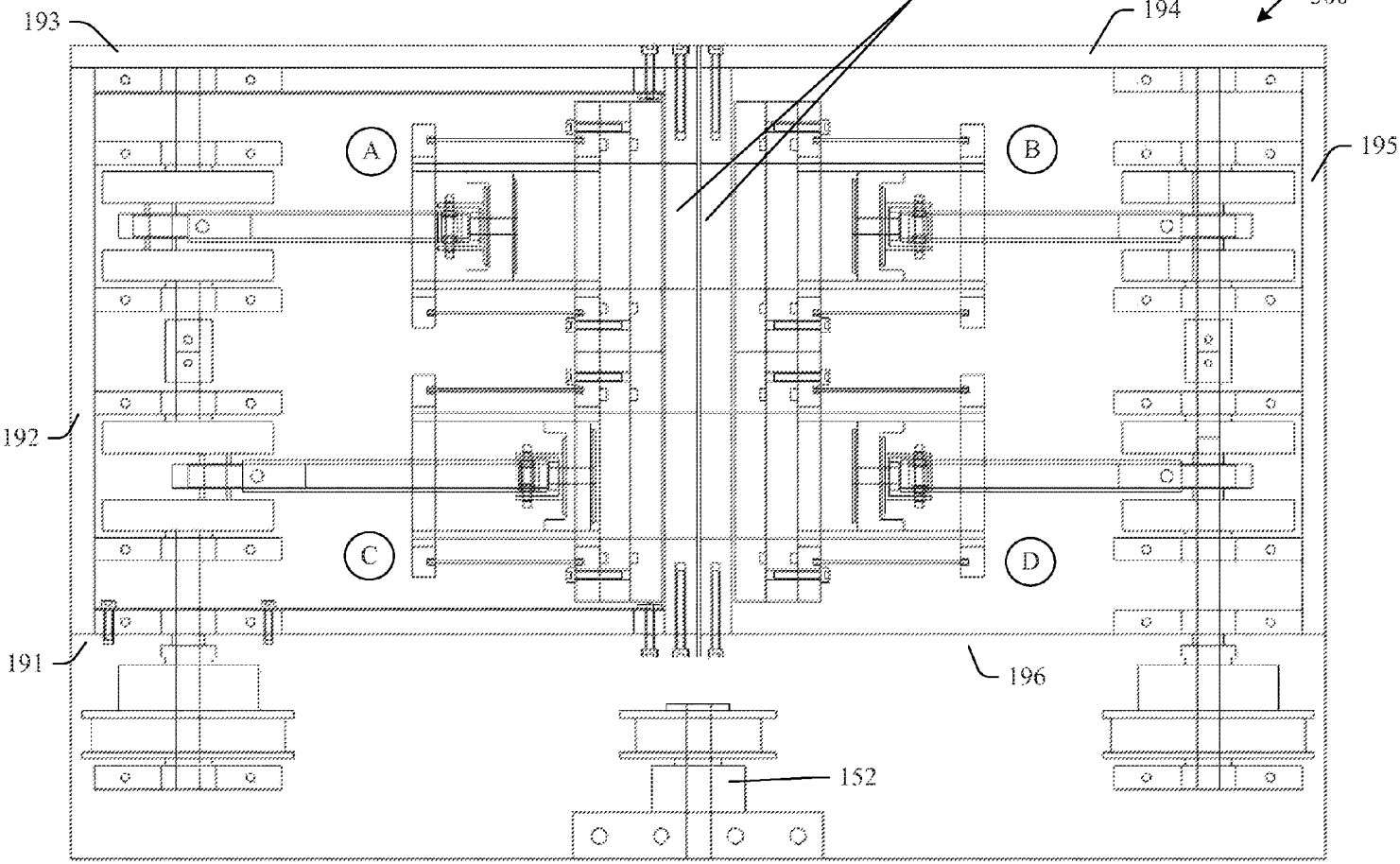
FIG. 3 illustrates an axially opposed engine configuration comprising two regenerators, in accordance with an aspect.

Separating the axially opposed piston assemblies A and B (e.g., cylinders 100A and 100B), and piston assemblies C and D (e.g., cylinders 100C and 100 D), respectively forming the hot and cold workspaces, is a regenerator 155. It is to be appreciated that while FIGS. 1 and 2 illustrate systems 100 and 200 comprising a single regenerator any number of regenerators can be employed to facilitate operation of an engine configuration in accordance with one or more aspects as presented herein. Turning to FIG. 3, an engine configuration is presented comprising of two regenerators 310 separating the axially opposed piston assemblies A-D.

It is to be further appreciated that while FIGS. 1 and 2 illustrate systems 100 and 200 comprising regenerators 155 being common to all for piston assemblies A, B, C, and D, the various aspects presented herein are not so limited and a first regenerator assembly can be employed between piston assemblies A and B, and a second regenerator assembly can be employed between piston assemblies C and D. Regenerators 155 facilitate passage of a working gas from one sick of the respective assembly to the other side (e.g., piston assembly A to piston assembly B, or piston assembly C to piston assembly D). Regenerators increase the efficiency of Stirling engines by absorbing a portion of heat energy from the working gas as it is transferred from the hot workspace to the cold workspace, then returning a portion of that heat energy to the working gas as it is transferred from the cold workspace to the hot workspace, thereby capturing and reusing heat energy that would other wise have to be wasted by the cooling system (s) or rep laced by the heating system(s) and thus reducing the load on both the heating and the cooling systems. Regenerator (s) 155 can be constructed from stacks of woven metal screens, perforated metal, coils of metal ribbon or other materials, shapes and systems having a sufficiently large surface area and a large heat capacity, thereby enabling a regenerator (s) 155 to act as both a heat storage device(s) and a heat exchanger(s), that both absorb and temporarily store heat removed from the working gas as it flows from the hot to the cold side and transfer heat to the working gas as it flows from the cold to the hot side. Suitable materials for constructing a regenerator(s) 155 include metals having properties that include high thermal conductivity, high heat capacity, etc. Such metals include copper, aluminum, stainless steel, alloys, etc. Further, cobalt-based and nickel-based "superalloys" with extremely hid operating temperatures, having a suitable compromise between heat capacity, thermal conductivity and operating temperature can also be used.

The crankshafts 120 and 130 can be supported by any suitable means, e.g., by crankshaft supports 180. The crankshaft supports 180 can include the necessary components to facilitate operation of the crankshafts 120 and 130, e.g., bearings, bearing housings, etc.

The various components comprising systems 100 and 200 (e.g., cylinders 100A-D, pistons 105A-D, connecting rods 110A-D, crankshafts 120 and 130, regenerators 155, crank shaft supports 180, can be contained M a housing comprising of sides 191, 192, 193, 194, 195, and 196, and top 198 and base 199. Further, to contain heat within the hot side of the engine, e.g., piston assemblies A and C, heat shield, 170 can be utilized and placed as required inside the housing.

The operating temperature of systems 100 and 200 can be limited by the materials employed to construct the various components comprising systems 100 and 200, e.g., operating temperature of the graphite piston, cylinders, regenerators, etc. However, the various aspects presented herein are not so limited, and are only limited to the operating properties of the materials comprising the various components and their physical, mechanical properties at a given temperature. In one aspect many of the components can be manufactured from aluminum to take advantage of its high strength to weight ratio. In another aspect, a more exotic material can be employed, such as INCONEL, WASPALLOY, and other materials intended for long-term operation at high temperatures. For example, a hot side operating temperature of about two hundred and sixty degrees Celsius (260° C.) or five hundred degrees Fahrenheit (500° F.), limited by the maximum temperature specification of the graphite piston and glass cylinder sets, but pistons assemblies could be mach that would easily exceed this temperature restriction.

It is to be appreciated that the greater the temperature differential between the hot and cold sides, the greater the power that can be produced by an engine. On the one hand, a higher operating temperature facilitates stronger expansion of the working gas, while a cooler operating temperature facilitates easier compression of the working gas, resulting in less energy being extracted from the rotating mass of the crankshafts and pulleys and flywheels, if separate or additional flywheels are used.

As shown in FIG. 1, crankshaft 120 includes pulley 122, which can be employed as a power take off shaft to rotationally drive other equipment. Further, crankshaft 130 includes a power take off shaft 123 that provides similar functionality to pulley 122 to rotationally drive other equipment. Pulley 122 and shaft 123 can be employed to deliver rotational energy to an engine when the engine is being utilized as a heat pump (as presented below in FIG. 17).

In a father aspect of the design, the crank shafts 120 and 130 can be extended beyond crank case sides 193 and 194 respectively and said crankshaft extensions used to mount additional flywheels and/or pulleys, thereby increasing the rotating mass of the engine, or additional drive pulleys to power equipment, machinery, electrical generators, etc.

To facilitate heating and cooling of the respective hot side and cold side components a variety of heating and cooling technologies can be employed. For example, in one aspect the engine can be air cooled, where extraction of heat can be facilitated by passage of air over the cold side cylinders, coo ling structures and crankcases(s) by convection in accordance with ambient conditions, or ambient or cooled air can be forcibly blown to cool the cold side cylinders, cooling structures and crankcases(s). In another aspect, the engine can be water-cooled. For example, in a low-technology configuration, cooling can be provided by a constant-loss tap water system employing a garden hose-style connection. In another example, a recirculating ice water system comprising a small water pump and garden hose-style connections can be employed to circulate the cooling water. It is to be appreciated that any suitable coolant can be employed to facilitate cooling. For example, a water and anti-freeze mixture or a dual-state system employing an alcohol or refrigerant that evaporates as it warms and condenses back to a liquid state in a heat exchanger or radiator, where the liquid condensate can be recirculated to cool once more.

In another aspect, to facilitate heating, any suitable heat source can be employed. Such suitable heat sources include, but are not limited to, electric heat lamps, electric heating coils, hot air guns, blows driers, gaseous feel burners (butane, propane, etc.), candles, alcohol lamps or burners, gel stoves, solid fuel stoves, and the like. For pollution-free operation, geothermal energy, waste heat or concentrated solar power are also suitable.

FIG. 3, system 300, illustrates an axially opposed engine configuration comprising a two regenerators 310 compared with the single regenerator shown in FIGS. 1 and 2.

Figure 4:
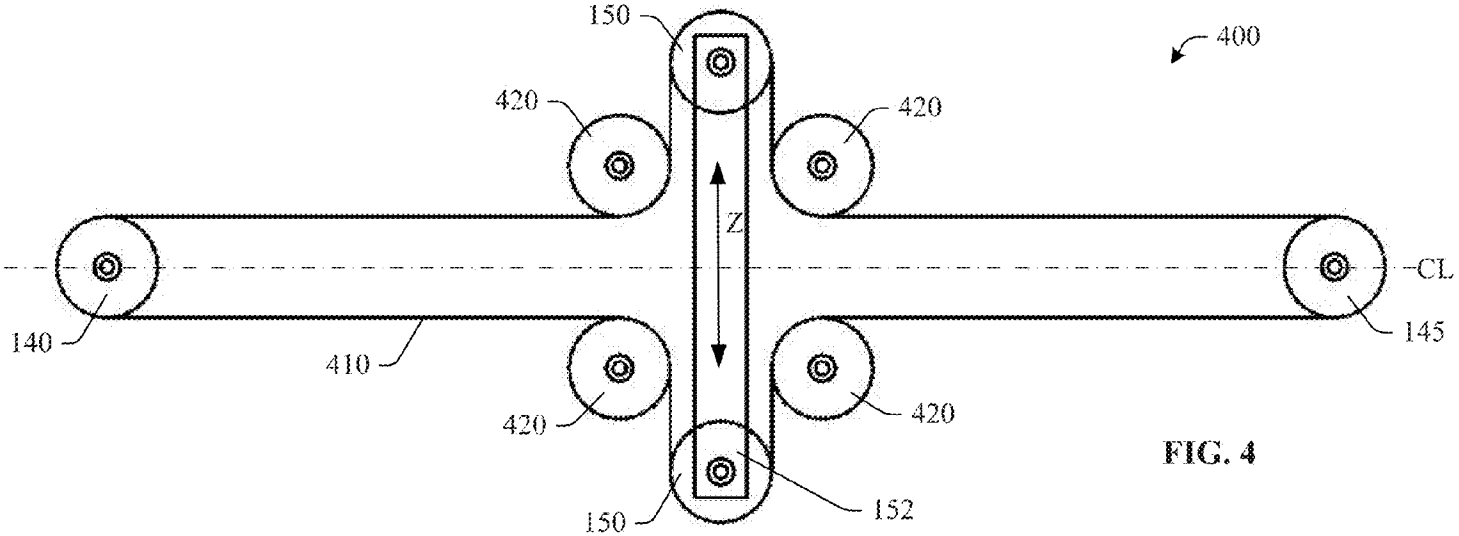
FIG. 4 illustrates a system to facilitate control of crank shaft timing according to an aspect.

Illustrated in FIG. 4, is system 400, that facilitates control of the engine speed in accordance with an aspect. System 400 comprises a timing belt 410, crankshaft timing pulleys 140 and 145, idler pulleys 420, and a slider mechanism comprising idler pulleys 150, and linear slick 152.

In one aspect, timing belt 410 can comprise of a toothed timing belt, or other suitable means of coupling crank shafts 120 and 130 to facilitate speed regulation of various components comprising a disclosed engine configuration, e.g., crankshaft timing pulleys 140 and 145, crank shafts 120 and 130, pistons 105A-D, connecting rods 110 A-D, etc. In conjunction with the toothed timing belt 410 and timing pulleys 140 and 145, idler pulleys 150 which are mounted on the linear slide 152 but free to rotate, and idler pulleys 420 that are fixed in position but free to rotate, can be toothed, or flat-faced, the system 400 working to facilitate accurate control (e.g., speed) of an engine (e.g., systems 100, 200, and 300) by varying the timing or phase relationship of crankshaft pairs A and C with B and D.

In a further aspect, the timing pulleys 150 are attached to linear slide 152 at a fixed distance apart but free to rotate. By moving the linear slide 152 up and down in direction Z, the relationship of the timing pulleys 140 and 145 is altered by the timing belt 410, as the timing belt 410 causes the timing pulleys 140 and 145 to rotate in relation to each other, causing timing pulley 140 to rotate clockwise and causing timing pulley 145 to rotate counter clock wise as the linear slide 152 is moved upward or causes timing pulley 140 to rotate counterclockwise and timing pulley 145 to rotate clockwise, as the linear slick 152 is moved downward. As the position of linear slick 152 is altered the relationship of the timing pulleys 140 and 145 is altered, causing the phase relation between crankshafts 120 and 130, and accordingly the position and timing of pistons 105 A-D (via connecting rods 110A-D) is effected, allowing control over the efficiency of the engine. In effect, movement of the slider mechanism (comprising slide 152 and idler pulleys 150) up and down, alters the timing of the crankshafts 120 and 130 and can vary engine power output in a rapid and precise manner. Further, movement of the slider mechanism (comprising slide 152 and idler pulleys 150) up and down also facilitates compression braking if moved to one extremity of the travel of slice 152 in direction Z and/or allowing the engine to coast if the slider mechanism is moved to the other extremity of the travel of the slide 152, making rapid and precise changes in engine speed (rpm), coasting and corn press ion braking possible.

Figure 5:
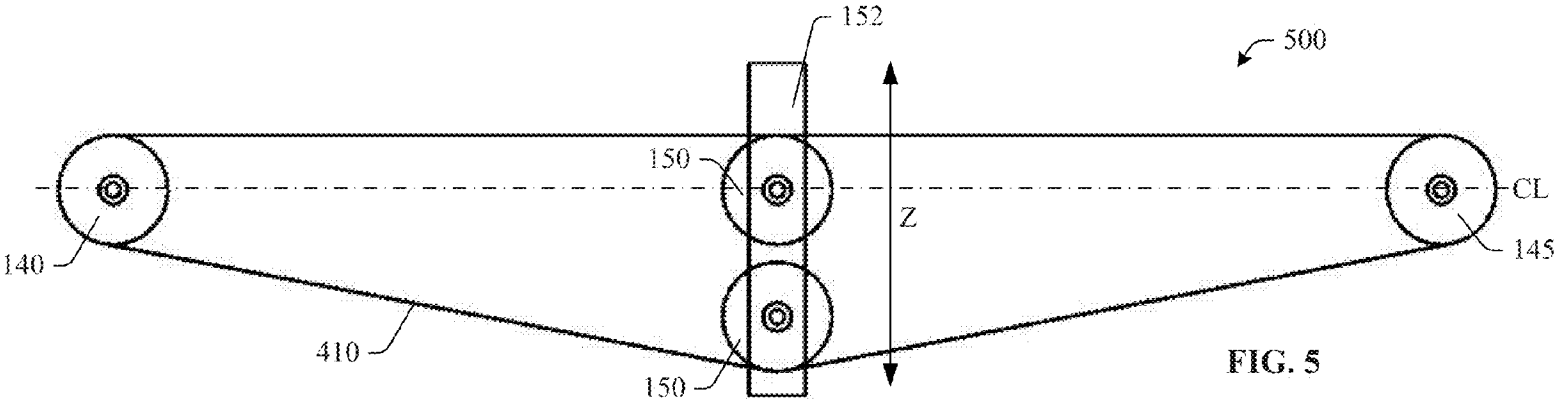
FIG. 5 illustrates a system to facilitate control of crank shaft timing according to an aspect.

Turning to FIG. 5, system 500, an alternative configuration to facilitate control of engine speed in accordance with an aspect, is illustrated. In comparison with FIG. 4, idler pulleys 420 are not employed. As the slider mechanism (comprising linear slice 152 and slideable idler pulleys 150) is moved up and down in direction Z, throttling of the engine is facilitated in a less rapid manner in relationship to the distance traveled by linear slide 152, in comparison with that achievable with system 400.

In the above discussion regarding systems 400 and 500, the location of slideable timing pulleys 150 are presented as being positioned with a fixed distance apart on slide 152. In another aspect, one or both of the idler pulleys 150 can be located/secured on slide 152 such that a degree of movement is enabled along slide 152. Accordingly, the distance between the idler pulleys 150 can be altered to compensate for various lengths, thicknesses, etc., of various components comprising systems 100 and 200. For example, different thicknesses of regenerator(s) 155 and 310 can be used and the variation in regenerator thickness can be compensated by adjusting the distance between the idler pulleys 150 on linear slide 152. In another example, more or fewer heater 160 and cooler 165 cooler plate pairs can be used and the resulting difference in crankshaft center-to-center distance can be compensated for by adjusting the distance between the idler pulleys 150 on slice 152. To facilitate adjustment of the distance between the two idler pulleys 150 mounted on slide 152, one or both of the slideable idler pulleys 150 can be mounted to an adjustment slot on slide 152 or by using a spring-loaded, linear belttensioning mechanism, or the like, thereby allowing the distance between the idler pulleys 150 to be adjusted and also to maintain a constant, or near-near constant tension on drive belt 410.

With reference to FIG. 3, the linear slide 152 is located outboard of the timing belt 410 (not shown in FIG. 3), so that its support does not cause a thermal short-circuit between the separate crankcases represented by the sides 194, 195 and 196 and the sides 191, 192, and 193.

In a further aspect, while not shown, movement of the linear slide 152 can be controlled by a compiler, processor, or the like, in conjunction with a means for accurate positioning of the slide, where such means includes an electric motor driven linear motion device. The computer/motor combination facilitates automatic throttling of an engine configuration, e.g., systems 100 and 200.

In another aspect, computers can also be employed to control the respective heating and cooling operations being utilized to heat or cool the hot workspace or the cold work space.

Figure 6:
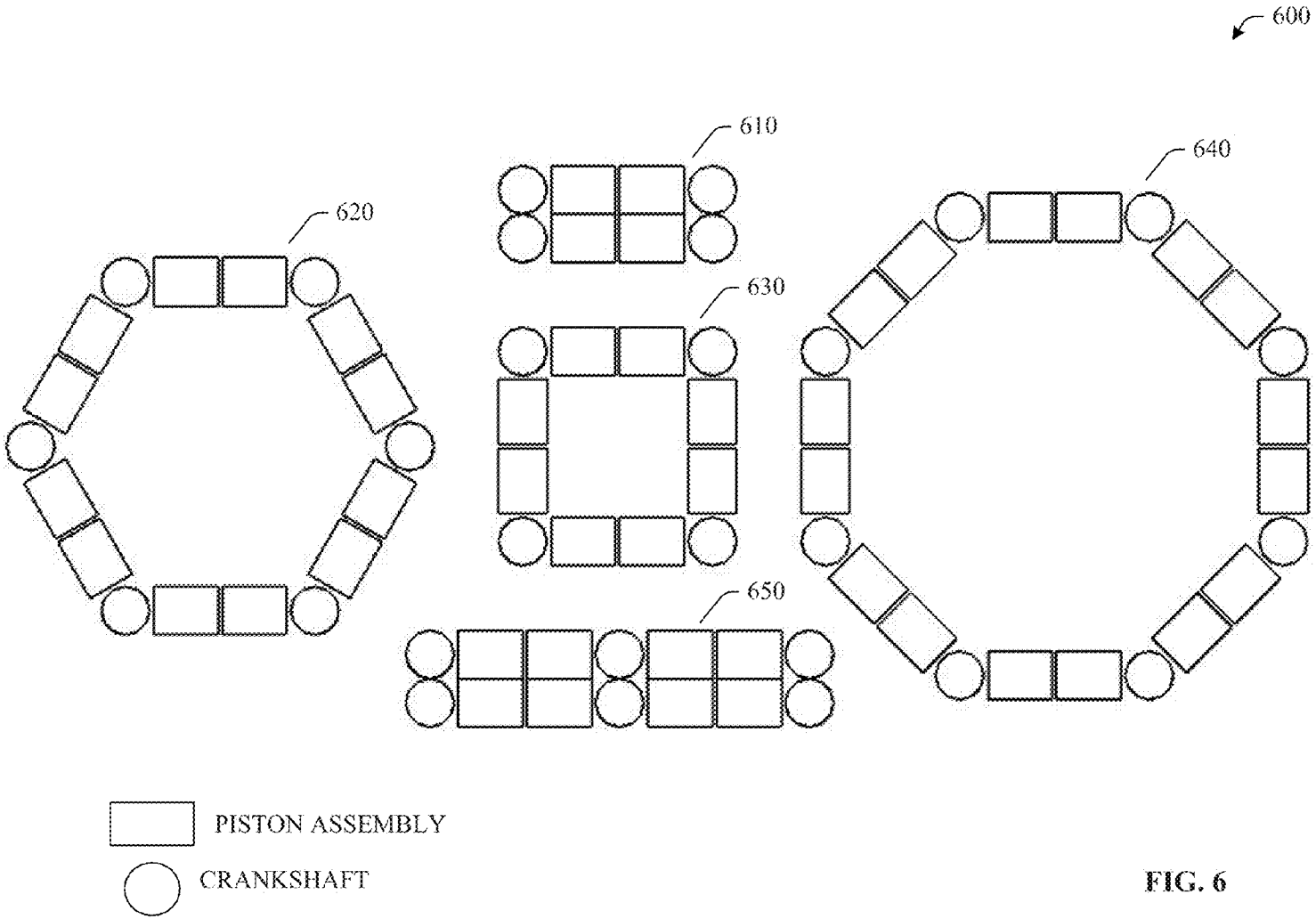
FIG. 6 illustrates various engine configurations, according to an aspect.

FIG. 6, system 600, presents a variety of possible engine configurations. As indicated, the rectangle symbolizes a piston assembly (e.g., piston assembly A, B, C, or D) and the circle symbolizes a crankshaft (e.g., crankshafts 120 or 130) to which one or more piston assemblies are coupled. Configuration 610 is comparable to systems 100 and 200. Configurations 620, 630, and 640 present various geometric arrangements of piston assemblies and crank shaft couplings. Configuration 650 comprises a plurality of systems 100 and 200. It is to be appreciated that the various aspects presented here in are not limited to the configurations illustrated in FIG. 6, but can be utilized in any configuration of piston assembly/assemblies and crank shaft combinations.

Figure 7:
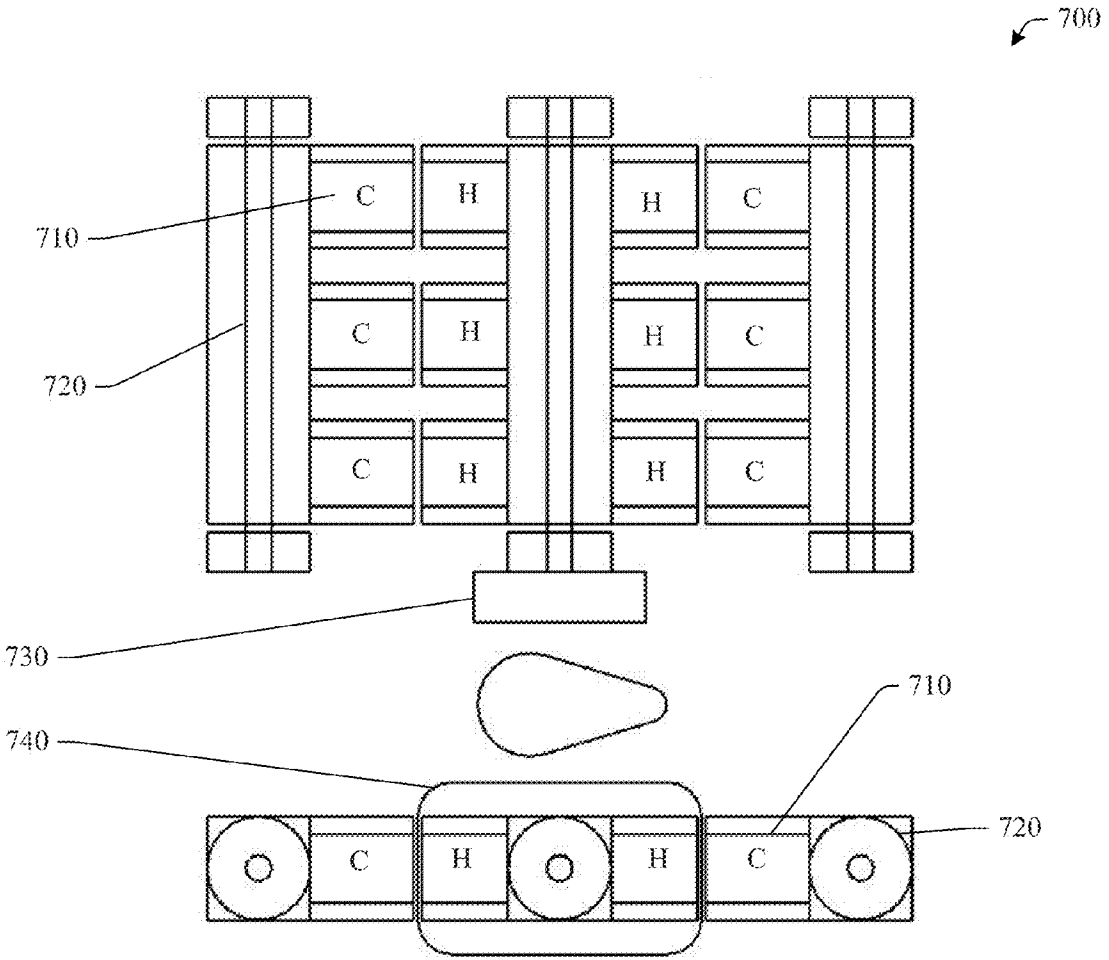
FIG. 7 illustrates an axially opposed engine configuration, according to an aspect.

FIG. 7, system 700, presents a top view and an end view of a possible engine configuration for use as an aircraft engine application. A plurality of piston assemblies 710 (e.g., FIGS. 1 and 2, piston assembly A, B, C, or D) are connected to a plurality of crankshafts 720 (e.g., FIGS. 1 and 2, crankshafts 120 and 130). During operation of the piston assemblies 710 converting heat energy into mechanical energy, rotation of a propeller (not shown) attached to propeller hub 730 is effected. In one aspect, piston assemblies operating as hot workspaces (denoted in FIG. 7, as H) can be located inside engine cowling 740, thereby allowing heat for the hot workspaces to be contained within the cowling 740. In another aspect, piston assemblies operating as cold workspaces (denoted in FIG. 7, as C) can be located externally to engine cowling 740, thereby facilitating extraction of heat from the cold work spaces, e.g., as the aircraft flies. It is to be appreciated that the various aspects presented herein are not limited to the configuration illustrated in FIG. 7, but can be utilized in any configuration of piston assembly/assemblies and crankshaft combinations.

Figure 8:
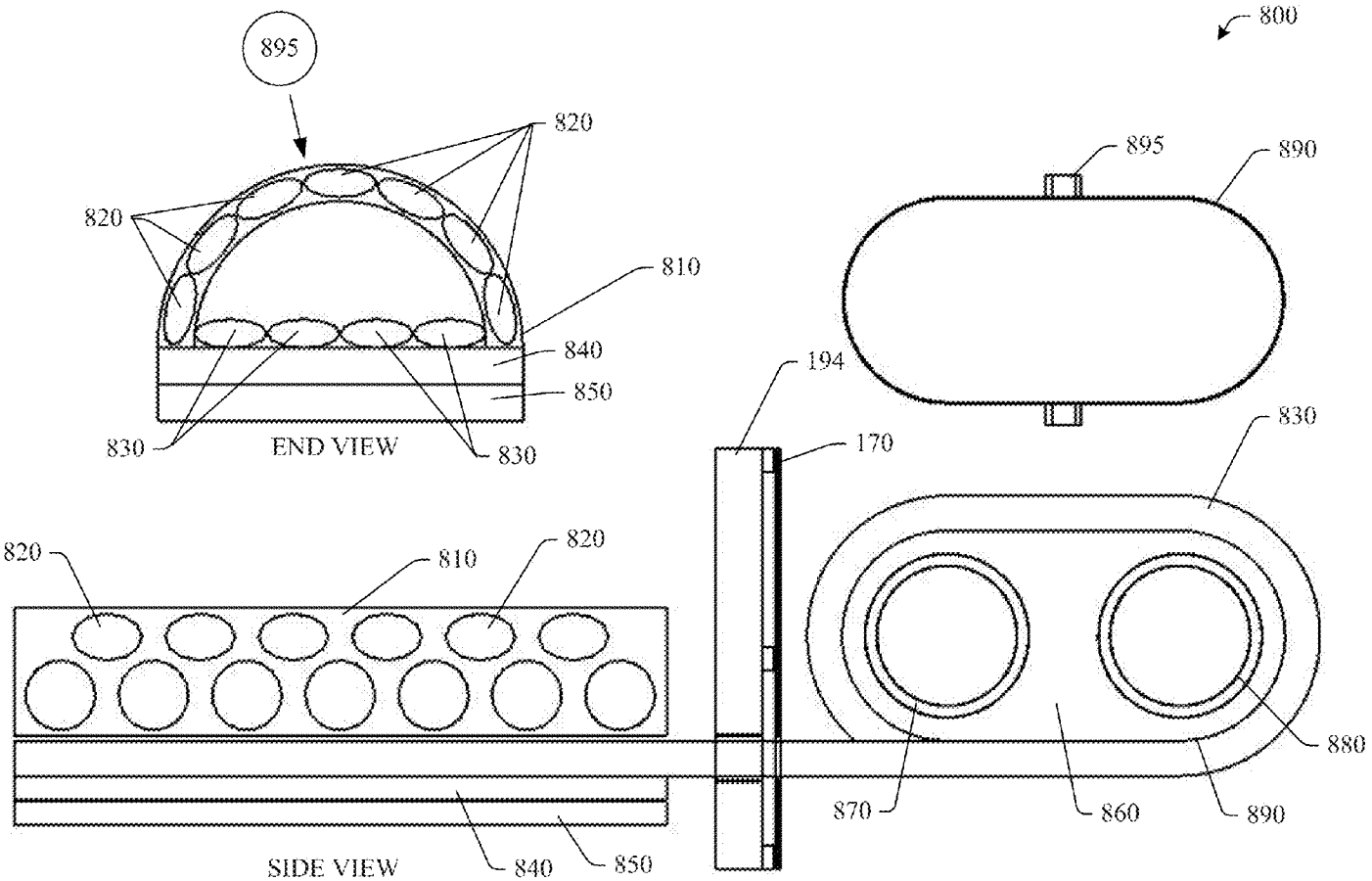
FIG. 8 illustrates a system for heating an engine using captured light, according to an aspect.

Turning to FIG. 8, system 800 presents a system for heating one or more engine cylinders. System 800 comprises of a lens system which directs/focuses light onto one or more pipes to facilitate heating of a fluid conveyed by the pipes, where the fluid can be employed to heat a piston assembly (e.g., piston assemblies. A plurality of lenses 820 are located in a lens mounting structure 810, whereby the lenses 820 have a suitable profile and arrangement to facilitate focusing of lint received from an external source, e.g., light soiree 895, onto one or more heat pipe(s) 830. It is to be appreciated that while system 800 depicts seven lenses 820 and four heat pipes 830 being combined to form the heating system, any suitable number of respective lenses and heat pipes can be employed.

In one aspect, the heat pipes 830 can be mounted onto a plate 840 having desired thermal conductivity properties, whereby plate 840 can prevent the generation of hotspots (e.g., one heat pipe 830 is being heated to a higher temperature than another owing to the position of a light source being aligned preferably to a particular lens 820 than another lens 820). One end of a heat pipe is formed to create an oval shape that closely fits the outside of a length of a sleeve 890 that surrounds one or more cylinders 870, 880, etc (e.g., cylinders 100A and 100C of piston assemblies A and C having a hot work space as shown in FIGS. 1 and 2). The heat pipe 830 can be filled with any medium suitable to convey heat collected at the lens mounting structure 810 and lenses 820, and convey the heat to the sleeve 890, and piston assemblies 870 and 880. For example, the mecum can be water, glycol, mercury, sodium, and the like. Further, the sleeve 890 can be constructed from any suitable material having desired thermal conductivity and temperature operation, for example, sleeve 890 can be constructed from stainless steel, sheet steel, etc. In one aspect the sleeve 890 can be made to the same length as the cylinders 870 and 880.

In one aspect, the heat pipe 830 is brazed or welded to sleeve 890 to facilitate maximum heat transfer of heat being carried in the heat pipe 830 to the sleeve 890.

In one aspect the heat pipe 830 is of sufficient length to extend beyond the bulk head (e.g., side 194) comprising an engine configuration (e.g., systems 100 and 200).

In another aspect the heat pipe(s) 830 can be supported from underneath by a plate 840 to which the heat pipe 830 is attached, e.g., by clamping or welding. In a further aspect, plate 840 sits on rigid insulation or an insulating ceramic board 850, to protect any surfaces below the heat pipe(s) 830.

In one aspect, the remaining volume 860 inside the sleeve 890 is filled with a material facilitating transfer of the heat being cony eyed in the heat pipes 830 to the cylinder 870 or 880, thereby by causing the cylinder 870 and/or 880 to be heated. In one aspect, volume 860 can be filled with molten bismuth alloy, via fill hole/fill plug 895. Owing to the expansion and contraction of the bismuth alloy a variable volume of a it space can be created in volume 860. In one aspect, fill plug 895 can be replaced by a short length of pipe and a suitable bellows assembly (not shown) to create the variable volume of air space, to allow for expansion and contraction of the bismuth alloy or other heat transfer medium.

The heat transfer medium inside the heat pipe(s) 830 can determine the maximum temperature the heat pipe(s) 830 will conduct efficiently. This feature allows the heat pipe(s) 830 to automatically regulate the amount of heat transferred to the hot side cylinders 870 and 880. heat pipe(s) 830 constructed from stainless steel and being water-filled can limit heat transfer to a maximum of about two hundred and twenty-seven degrees Celsius (227° C.) or four hundred and forty degrees Fahrenheit (440° F.).

In a further aspect, cooling fins (not shown) can be affixed to the exterior of the heat pipe(s) 830, between the portion of the heat pipe 830 that is heated (e.g., by solar) by lenses 820, and the bulkhead (e.g., side 194) surrounding the area where the hot side cylinders 870 and 880 are located. Employing cooling fins can limit the amount of heat energy that can be transmitted through the heat pipe(s) 830, to the hot side cylinders 870 and 880. It is to be appreciated that any suitable heat sink stricture can be utilized instead of, or in addition to, the cooling fins. Further, the cooling fins can be constructed to perform an ancillary function such as supporting cook ware. If the cooling fins and/or other heat sinks, prove ineffective in preventing overheating of the hot side cylinders 870 and 880, the heat pipe(s) 830 can be parted between the cooling fins and the bulkhead, and a length or loop of reinforced high-pressure flexible hose, like that widely used in industrial hydraulic systems, can be used to provide a break in the heat path provided by the heat pipe(s) 830.

System 800 can utilize any suitable lens 820 array, for example, a hemispherical or arched tubular array of domed, convex or Fresnel lenses, to concentrate sunlight onto one or more heat pipes 830. Owing to a proximity of one heat pipe 830 to another heat pipe 830, and the heat pipe(s) 830 can be mounted on a thermally conductive plate 840 and located thereby with welding or clamping the concentrated solar energy does not have to be accurately aimed.

Figure 9:
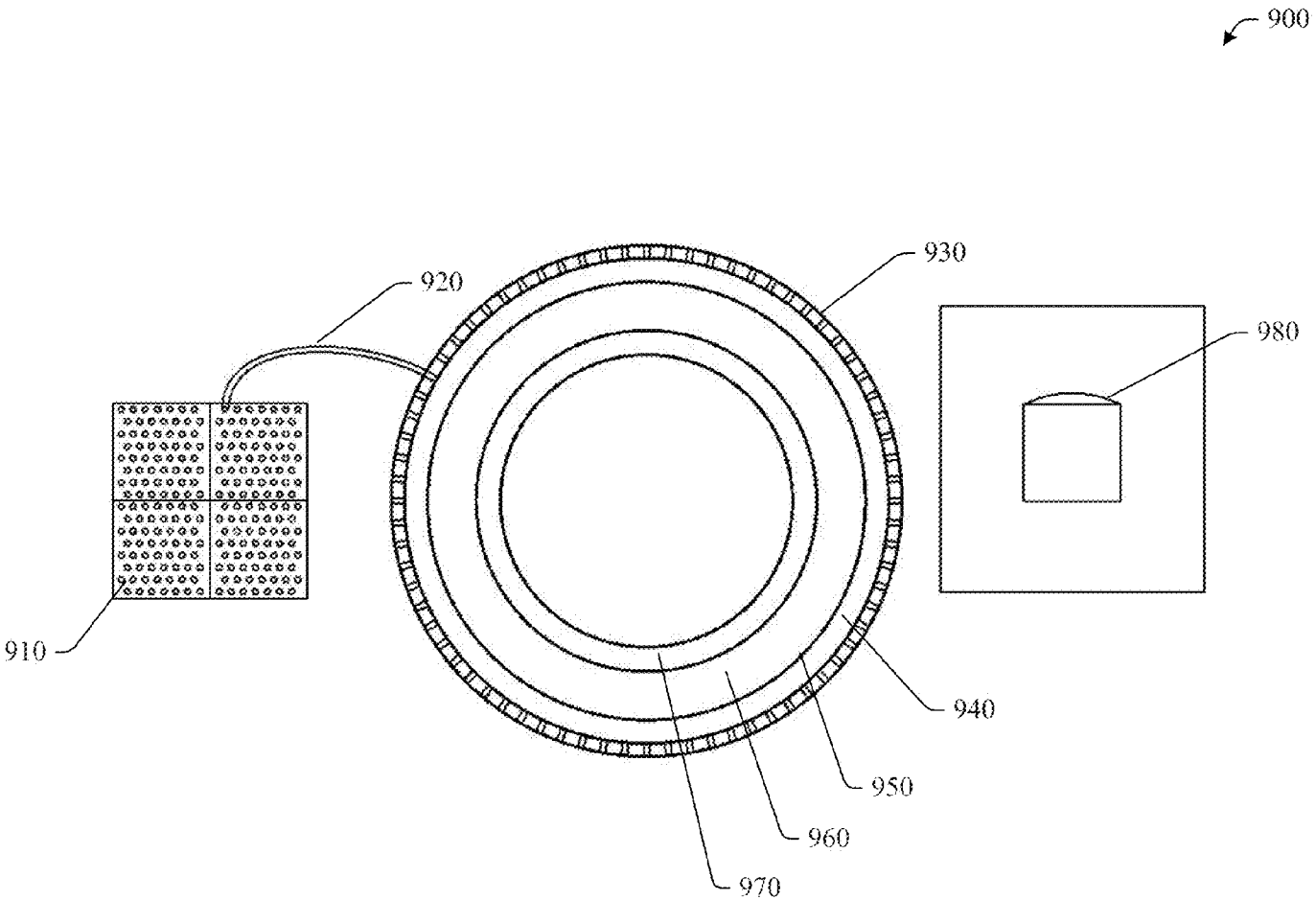
FIG. 9 illustrates a system for heating an engine using captured according to an aspect.

Turning to FIG. 9, system 900 presents a system for gathering sunlight and transmitting the sunlight to facilitate heating of an engine cylinder. Panels 910, comprising a plurality of optical fibers 920, are used to gather sunlight. In an aspect, a light-gathering end 980 of each optical fiber 920 can be domed thereby forming a lens that gathers sunlight, concentrates the sunlight and focuses the sunlight into the center of the optical fiber 920 for transmission to the other end of the optical fiber 920 which is located in housing 930, where the sunlight is utilized to heat the hot side cylinder 970 of an engine (e.g., cylinders 100A and 100C of piston assemblies A and C having a hot work space as shown in FIGS. 1 and 2). Housing 930 can comprise of a plurality of optical fibers 920, where the optical fibers 920 are located across the whole region local to cylinder 970. For example, as shown in FIG. 9, housing 930 comprises a plurality of evenly spaced holes into which are located an optical fiber 920 to facilitate even heating of cylinder 970. In an aspect, light collected by the optical fibers 920 comprising housing 930 can be directed across an insulating air gap 940 and directed on a container surface 950 which contains any suitable heat transfer medium in the volume 960 created between the container surface 950 and the outer surface of engine cylinder 970.

Panel 910 can be of any shape or size and have incorporated therein any number of optical fibers 920 to facilitate heating of cylinder 970. In an aspect, system 900 is suited to applications where there is a large surface area near an engine, such as fenders, a hood (bonnet), engine cover, walls, doors etc., or on motorcycles, where a large part of the bodywork could be in shadow at any one time. System 900 can provide light weight, flexible light-gathering panels 910 suitable for use as curved or flat vehicular body panels, for mounting on walls, roofs, engine compartments and other structures, or panels 910 that are made rigid and self-supporting or capable of supporting a substantial load. System 900 also allows existing car hoods, fender building walls, etc. to be retrofitted by simply drilling an array of holes in them, of the right size for mounting the optical fibers with a compatible adhesive, to create a panel 910 comprising a plurality of optical fibers 920.

In an aspect, the minimum thickness of a light gathering panel 910 may be controlled by the minimum bending radius of the optical fibers 920. However, optical fibers 920 having a suitable light gathering end configuration can be employed, where the light gathering end configuration can be comprised of mirrors, prisms, or have mirrors or prisms affixed to them, allowing the optical fibers 920 to lay flat, or nearly flat, against their mounting surfaces, so thinner, more flexible panels 920 can be made, or to allow more panel interior area to be dedicated to structural members, for making thicker, more rigid panels that can be used as structural members for buildings, vehicles, etc.

Aspects of system 900 can be employed in conjunction with aspects of system 800. In one aspect, board 850 can be left off of the bottom of plate 840 to which heat pipe(s) 830 are fixed, such that solar energy can be transmitted by optical fibers 920 to plate 840, either from a light-gathering panel 910 or from a light pipe configuration described below. The solar energy the optical fibers 920 provide could be directly applied to the hot side cylinder containment structure, but then the automatic temperature regulation feature of the heat pipes would be lost. The system works becalm sunlight that is gathered over a large area and concentrated into a small arm, that of the hot side cylinders or their heat transfer and/or containment devices and/or structures.

In another aspect, light pipes can be utilized to provide a cost effective way of transmitting sunlight over a distance to an engine (e.g., systems 100 and 2000. Optical fibers 920 are small, hence a large bundle of optical fibers 920 can be expensive. When transmitting light from one point to another, e.g., from the back to the front of a long truck or trailer, light pipes could be a less expensive option. Traditionally, light pipes are made using stainless steel tubes whose interior is plated with gold or aluminum, then polished. A cheaper alternative light pipe can be created by polishing the interior of thin-walled aluminum tubing. In an aspect, the light pipe ends are sealed with convex lenses, dome lenses, parabolic concentrator lenses, optical windows, etc., as required. In another aspect, air can be paged from the tubing and replaced with nitrogen, preventing oxidation of the polished surface. By using such a system on all four sides of a vehicle or on the roof of the cabin, cargo box, etc., in a circular arrangement or facing in at least four directions, an omnidirectional light gathering system can be created. Such a system could also easily be mach into bumpers, rollover bars and side bars. A light pipe bawd system can be an ideal supplement to both the lens and heat pipe system 800 and the fiber optic system 900 presented above. Any or all of above described systems can be combined to produce a hybrid solar heating system, to provide the most effective and/or cog-effective solar heating system possible, for both mobile and stationary applications, e.g., a system comprising system 800, system 900, and the light pipe system.

Figure 10:
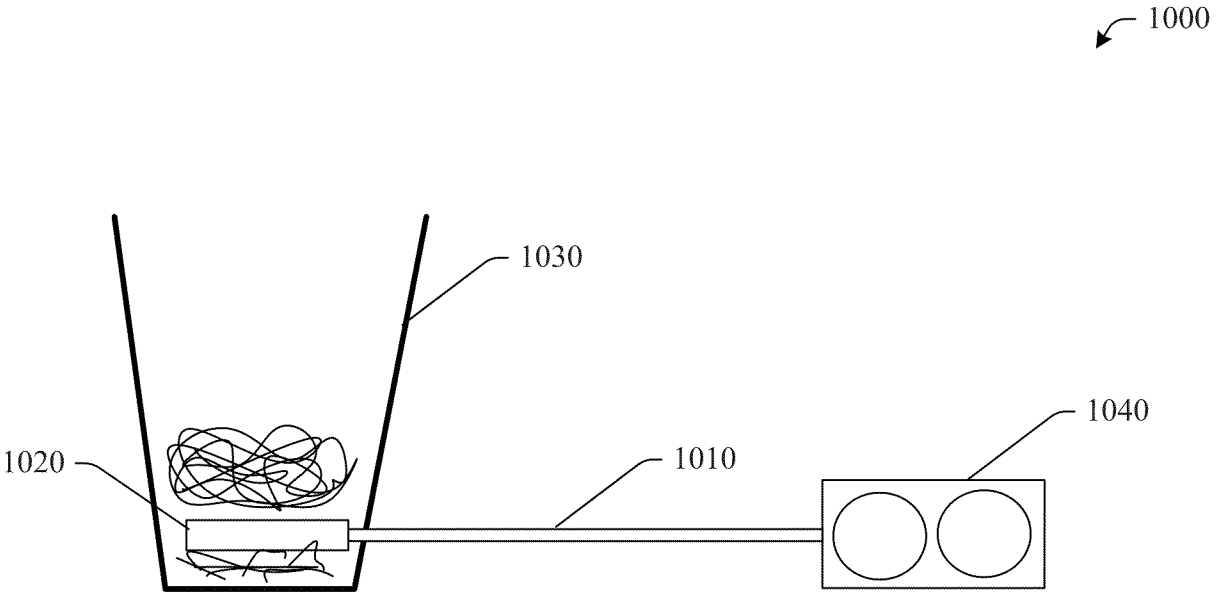
FIG. 10 illustrates a system for heating an engine from remotely located heating means, according to an aspect.

Turning to FIG. 10, system 1000, an application of heat pipe technology for heating an engine utilizing a stove is presented. Heat pipes 1010 (having features as presented with regard to heat pipes 830) can be made into a grating 1020 that is used to support hot coals and fuel inside a solid-fuel stove or furnace 1030, providing a way to easily couple an engine 1040 (e.g., systems 100 and 200) to existing wood stoves and furnaces, other solid-fuel stoves and furnaces, and waste heat sources. Excellent heat transfer is facilitated owing to the hot coals being in direct contact with the heat pipes 1010/grating 1020. Unlike flue-Eased heat exchangers, there is no creosote build-up and the grating 1020 can be easily cleaned with a manual or motorized shaker system or by simply brushing and/or tapping the heat pipes comprising the grating 1020 occasionally, as necessary. An ash drawer or auger system can be used to regularly remove excess ash, to help prevent clogging of the grating 1020. System 1000 can be easily retrofitted into existing solid-fuel stoves and furnaces, or incorporated into new production. The heat pipes 1010/grating 1020 can also be fitted into many commercial and industrial flues, vents, etc. As with the solid-heated water-filled heat pipes 830, hydraulic hoses can be used to provide a thermal break and prevent overheating of low-temperature engines and to iso late said engines from the shock loads created by replenishing the fuel in the stove or furnace. High-temperature engines using sodium-filled heat pipes could be rigidly mounted to the stove, furnace or wage heat so urce. A plurality of systems 1000 can be stacked or scaled to take advantage of almost any quality heat soiree.

In another application, an engine configuration can be utilized in conjunction with a lava sled heating system. The lava sled heating system provides a simple and effective way to take advantage of open lava floes as a heat source for a high-temperature configured engine. An anchor post or beam is set in the ground uphill from a bend in the lava floe. A sled is attached to said post via cable. The sled contains one or more configured engines (e.g., systems 100 and 200). The hot side cylinders of said engines are either directly coupled to the sled and/or windows are made into the bottom of the sled, to directly expose the hot sidle cylinders to the infrared heat energy given off by the lava. Fresh or seawater for cooling, is provided to the cold side(s) of the engine(s) by a large hose that is concentric to the attachment cable and also contains the electric power cables, keeping all of them cool. Excess water is drained off of or sprayed from the hick of the sled, to prevent cooling the lava as it flows under the sled. In operation, the hose and cable bundle is always suspended above the lava and never allowed to touch it. The anchor post or beam can be easily relocated as the course of the lava floe changes over time. The base of the sled should be double-walled and the anchoring attachment point and any other structures should be boxed in, to provide flotation, should the sled lose anchorage and ride the lava floe into the water. The engine(s) can be monitored using wireless sensor technology.

In a further application, an engine can be utilized in conjunction with a sewage, manure and trash to power systems. When a sewage dewatering system is combined with a shredder and a briquette press, manure, bedding, sewage solids and other combustible solid wastes (garbage) such as paper, cardboard, sawdust, scrap wood, lawn clippings, food scraps, etc., can be converted from health, pollution and disposal problems into fuel for a stove or furnace to heat an engine as presented herein, turning waste into mechanical or electrical power, while providing press liquor for use in methane-producing digesters, as a liquid fertilizer or for disposal in a municipal wastewater system, leach field or finger system, etc. A small automatic-feed briquette-burning stove can be used a lone, to heat an engine, or it can be used to act as a backup system for a solar-heated engine. Solid-state igniters are available or a small amount of biofuel, propane or other fossil fuel, could be used to quickly light briquette, sawdust-pallet, or grain stoves using manual or automated controls, based on engine hot side cylinder temperature.

In another aspect of operation, the engine can be utilized to condense water out of atmospheric air with the cold side cylinders, helping to alleviate water shortages around the world. To provide a large surface area for condensation to occur, the bottom of the area that encloses the cold side cylinders, should be filled with a plastic or rubber part having many snail holes, in which lengths of thin-walled stainless steel tubing can inserted and held in place by friction. The tubes should extend down into a suitable water, collection container. This solution allows the tubes to be removed one at a time, after use, and any remaining water to be blown out or wiped off, into the water container, then air-dried or sun-dried to prevent any mold, fungal or bacterial contamination. The heat pumps can also provide cold for freezers, refrigerators, dehumidifiers or for cooling dwellings, while also providing heat for cooking, hiking, boiling water or warming a dwelling. The heat pumps can be powered by a hand crank, foot pedals, a treadmill, and the like, or can be wind powered or driven by a motor or engine, etc. They can also drastically reduce the amount of indoor air pollution in households where wood or dung stoves are traditionally used, and help end deforestation. The system will also provide a defense against terrorist attacks that target municipal or community drinking water systems.

FIGS. 11 and 12, present systems 1100 and 1200, which are comparable to systems 100 and 200 illustrated in FIGS. 1 and 2, but, to facilitate better understanding of the various aspects disclosed herein, the various components comprising systems 1100 and 1200 (and correspondingly systems 100 and 200) have not been indicated.

In another aspect, rather than piston-cylinder assemblies being used, bellows assemblies can be substituted. Bellows assemblies have a nearly infinite life of over 500,000,000 cycles. The bellows require work to compress them, but like a spring give hick almost all of the energy put into them as they extend again. A can in the center of the bellows takes up the dead space when the bellows is closed. As pleats open, surface area increases exponentially. To facilitate heat ing of the bellows, electric heating elements can be attached to the outer edges of the bellows. Bellows assemblies can be employed and work with the same heaters, coolers and regenerators employed on piston engines. Bellows are available with outside diameters and lengths of less than an inch to more than six inches. One effect of using bellows is the air surrounding the bellows can provide resistance to the concertina movement of the bellows, hence to minimize the resistance, operation of a bellows engine in a vacuum or partial vacuum may be desirable. Bellows have almost zero friction, except for the linear slides (comparable to ball bearings). Bellows have a large surface area when compared to the smooth inside diameter of a cylinder.

In view of exemplary systems shown and described herein, methodologies that may be implemented in accordance with the disclosed subject matter, will be better appreciated with reference to various flow charts. While, for purposes of simplicity of explanation, methodologies are shown and described as a series of blocks, it is to be understood and appreciated that the claimed subject matter is not limited by the number or order of blocks, as some blocks may occur in different orders and/or at substantially the same time with other blocks from what is depicted and described herein. Moreover, not all illustrated blocks may be required to implement methodologies described herein. It is to be appreciated that functionality associated with blocks may be implemented by software, hardware, a combination thereof or any other suitable means (e.g. device, system, process, component). Additionally, it should be further appreciated that methodologies disclosed throughout this specification are capable of being stored on an article of manufacture to facilitate transporting and transferring such methodologies to various devices. Those skilled in the art will understand and appreciate that a methodology could alternatively be represented as a series of interrelated states or events, such as in a state diagram.

Figure 13:
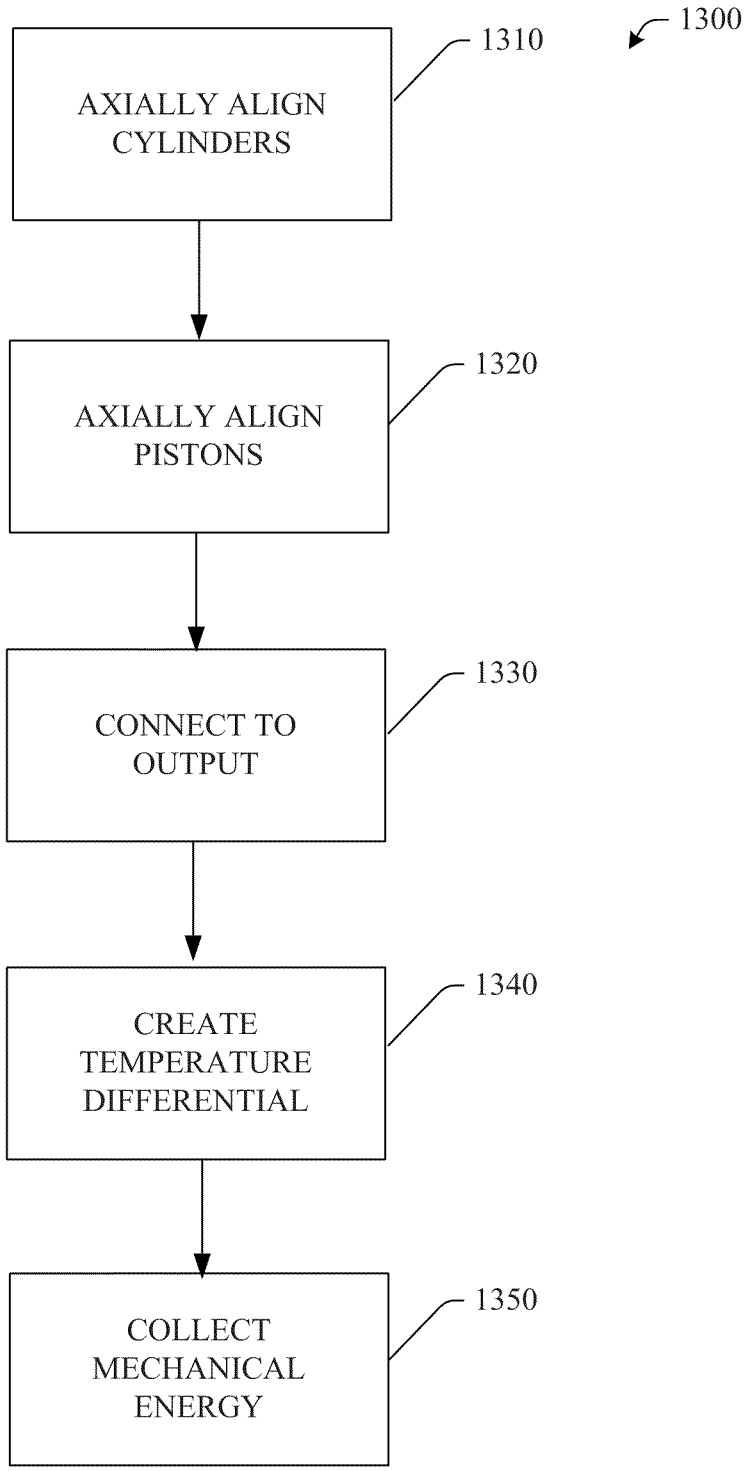
FIG. 13 illustrates a methodology presenting the basic operation of an engine configuration, in accordance with an aspect.

FIG. 13, presents methodology 1300 presenting the basic operation of an engine configuration. At 1300 cylinders (e.g., cylinders 100A-D) which will respectively form a hot workspace and a cold workspace are axially aligned. The two cylinders are separated by a regenerator (e.g., regenerator 155) which facilitates passage of a working gas from a hot workspace to a cold workspace. Further, the cylinders can be separated by heating and cooling components (e.g., heating blocks 160 and cooling blocks 165), which can be employed to facilitate creation of a temperature differential between the hot workspace and the cold workspace as the working gas passes therebetween.

At 1320 pistons are axially aligned. Each cylinder includes a piston assembly (e.g., piston 105A-D) which act to seal the cylinders to create the respective hot workspace and cold workspace on either side of the regenerator.

At 1330 the pistons are connected to an output. Operation of a Stirling engine comprises of capturing energy in the form of heat and converting that captured energy as mechanical energy. In the hot workspace the working gas is heated which causes the working gas to expand, and in the cold workspace the working gas is cooled causing the working gas to contract. Such expansion and contraction of the working, along with the accompanying transfer of the working gas between the respective hot workspace and cold workspace generates motion of the pistons within the cylinders. By connecting the pistons to crankshafts (e.g., crankshafts 120 and 130) the motion of the pistons can be captured along with the mechanical energy generated by the passage of the working gas between the hot working space and the cold working space. Connection of the pistons to the crankshafts can be facilitated by connecting rods (e.g., connecting rods 110A) coupled to the pistons which transfer the piston motion to the crankshafts. Further to facilitate collection of the mechanical energy, maintain timing and to also create required phase angles between the pistons, connecting rods, and crankshafts a timing mechanism (e.g., timing pulleys 140 and 145, timing belt 410, idler pulleys 420, idler pulleys 150, linear slide 152, etc.) is coupled to the ends of the crankshafts 120 and 130.

At 1340 a temperature differential is created between the respective hot workspace and the cold workspace which creates passage of the working gas between the respective hot workspace and the cold workspace. The passage of the working gas, in conjunction with the pistons being coupled to the crankshafts, causes the pistons to reciprocate back and forth along a length of their respective cylinders. Heat is externally applied to the cylinder comprising the hot workspace. Various means are available for generating the heat including concentrated solar power (e.g., produced by systems 800 and 900), combustion, convection, forced heating, burners, stoves (e.g., system 1000), geothermal, waste heat, and the like. Alternatively, on the cold side heat is extracted to cool the working gas in the cold workspace. Various technologies can be applied to cool the cold workspace including water-cooling, blowing cooled air, cooling using liquid mediums (e.g., water/glycol mix) refrigeration, condensation, heat exchanger, and the like.

At 1350 the mechanical energy generated by the engine is collected. The heat energy of the working gas is transferred into mechanical motion of the pistons, which is transferred, via the connecting rods, to the crankshafts, power take off shaft (e.g., shaft 123) of a crankshaft, a pulley (e.g., pulley 122) connected thereto, etc.

Figure 14:
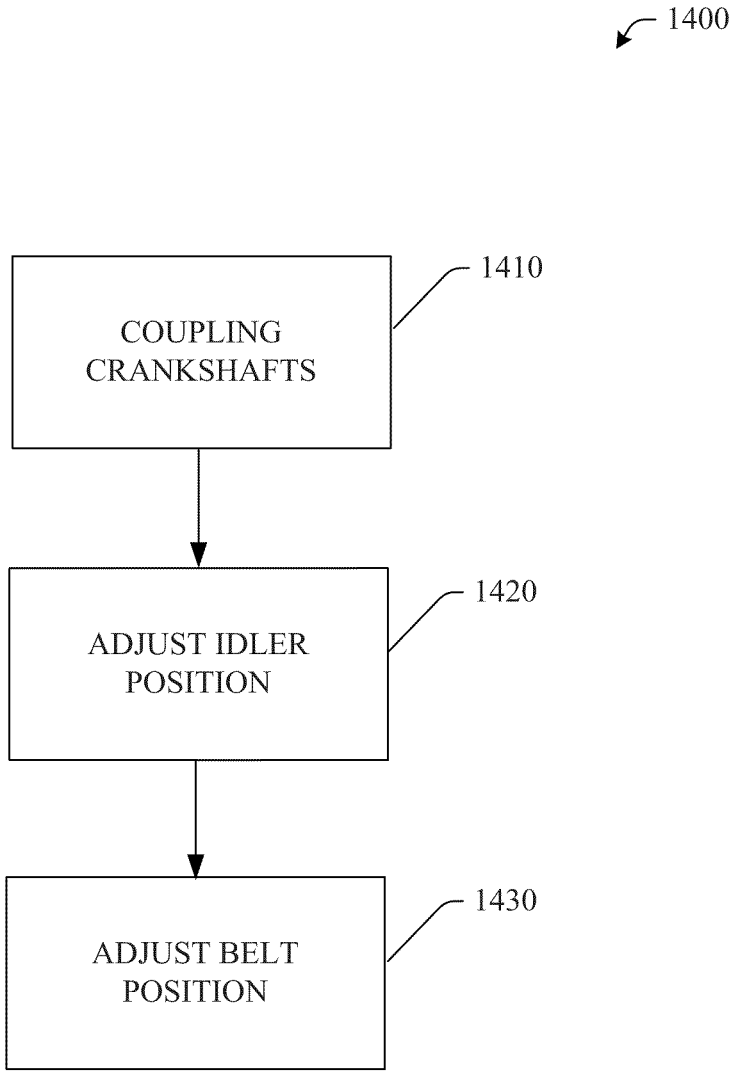
FIG. 14 illustrates a methodology for throttling an engine, in accordance with an aspect.

FIG. 14, presents methodology 1400 present ing a process for throttling an engine. At 1410 engine crankshafts (e.g., crankshafts 120 and 130) are coupled. Reciprocating motion of engine pistons (e.g., pistons 105A-B) facilitates the transformation of heat energy being applied to hot workspace and cold workspaces (e.g., the respective enclosed volume created by cylinders 100A-D, pistons 105A-D, heater(s) 160, cooler(s) 165, and regenerator(s) 155) into mechanical energy (rotational energy) of the engine crankshafts. To facilitate timing and maintain phase angles between the pistons, connecting rods, and crankshafts, a timing mechanism (e.g., timing pulleys 140 and 145, timing belt 410, idler pulleys 420, idler pulleys 150, linear slid 152, etc.) are coupled to the ends of the crankshafts 120 and 130.

At 1420 the position of a slid (e.g., linear slide 152) and accompanying idler pulley(s) (e.g., idler pulleys 420) is adjusted the relationship between the timing pulleys attached to the end of the crank shafts is altered by movement of the timing belt in response to the idler pulley position adjustment.

At 1430 the relationship of the timing pulleys is altered by the timing belt, as the timing belt causes the timing pulleys to rotate in relation to each other, causing a first timing pulley to rotate clockwise and causing a second timing pulley to rotate counterclockwise as the linear slide is moved upward or causes the first timing pulley to rotate counterclockwise and the second timing pulley to rotate clockwise, as the linear slid is moved down ward. As the relationship of the timing pulleys is altered, a corresponding adjustment of the phase relation between the coupled crankshafts results thereby affecting the position and timing of the connected pistons, allowing control over the efficiency of the engine. Effectively, movement of the slide up and down, alters the timing of the coupled crankshafts to vary engine power output in a rapid and precise manner. Further, movement of the slider mechanism up and down also facilitates compression braking if moved to one extremity of slide travel or allowing the engine to coast if the slider mechanism is moved to the other extremity of slide travel, facilitating rapid and precise changes in engine speed (rpm), coasting and compression braking possible.

Figure 15:
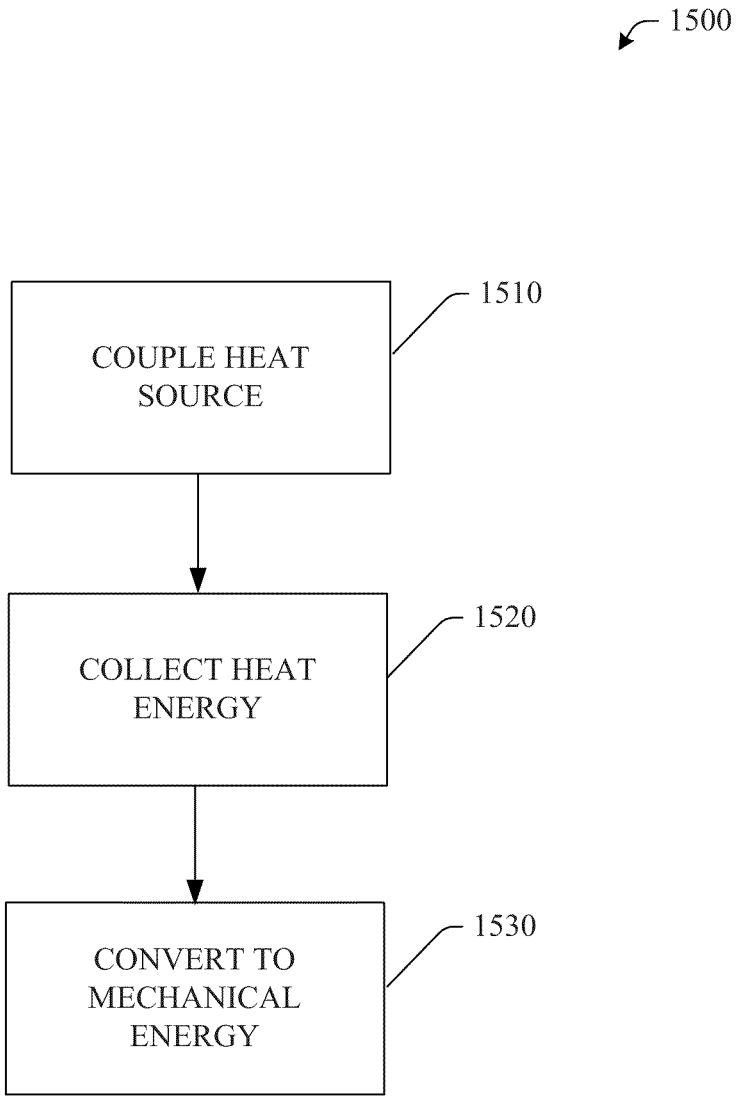
FIG. 15 illustrates a methodology for heating an engine, in accordance with an aspect.

FIG. 15, presents method logy 1500 presenting a process for heating an engine. At 1510 a heating system is coupled to a hot workspace cylinder (e.g., cylinder 100A or 100C). The heating system facilitates conveying heat collected from a remote source and transferring the heat to the hot work space cylinder. In one aspect the heating system can comprise one or more tubes (e.g., heat pipe 1010) containing a medium facilitating heat transfer, e.g., the medium can be water, glycol, water-glycol mix, mercury, sodium, and the like. The tubes can be arranged to form a grating (e.g., gating 1020).

At 1520 heat local to the heating system causes the medium being conveyed by the tube to be heated. The medium retains the heat and the heat is conveyed to the hot workspace cylinder.

At 1530, working gas in the hot workspace is heated causing the gas to expand. Expansion of the working gas accordingly facilitates a reciprocating movement of a piston (e.g., piston 105A or 105C) contained in the hot workspace cylinder. As the engine proceeds to operate with transfer of the working gas, heating of the working gas, cooling of the working gas, etc., piston motion is transferred to a crankshaft (e.g., crankshaft 120 or 130) thereby facilitating the conveyance of heat from a remote heat source to the hot workspace, and further conversion of the heat energy to mechanical energy.

Figure 16:
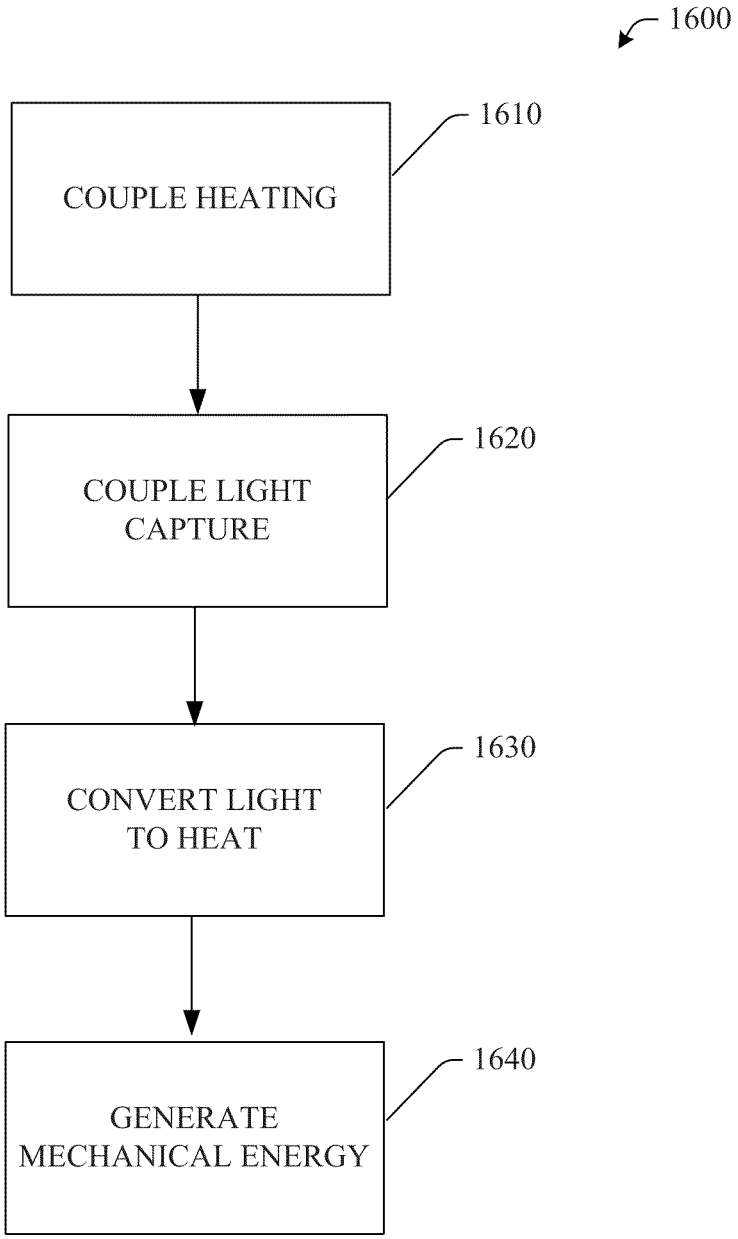
FIG. 16 illustrates a methodology for capturing light energy and heating an engine, in accordance with an aspect.

FIG. 16, presents methodology 1600 presenting a process for capturing light energy and heating an engine. At 1610 a heating system is coupled to a hot workspace cylinder (e.g., cylinder 100A or 100C). The heating system facilitates conveying heat collected from a remote source and transferring the heat to the hot work pace cylinder. In one aspect the heating system can comprise one or more tubes (e.g., heat pipe 830) containing a medium facilitating heat transfer, e.g., the medium can be water, glycol, water-glycol mix, mercury, sodium, and the like.

At 1620 light capturing equipment is coupled to the heating system. The light capturing equipment can comprise a housing (e.g., housing 810) which includes one or more lenses (e.g., lens 820) which focus light falling thereon onto the one or more tubes.

At 1630, the light focused on the tubes causes the medium being conveyed by the tube to be heated. The medium retains the heat and the heat is conveyed to the hot work space cylinder.

At 1640, working gas in the hot workspace is heated causing the gas to expand. Expansion of the working gas accordingly facilitates a reciprocating movement of a piston (e.g., piston 105A or 105C) contained in the hot workspace cylinder. As the engine proceeds to operate with transfer of the working gas, heating of the working gas, cooling of the working gas, etc., piston motion is transferred to a crankshaft (e.g., crank shaft 120 or 130) thereby facilitating the cony ers ion of light energy (e.g., solar energy) to mechanical energy.

Figure 17:
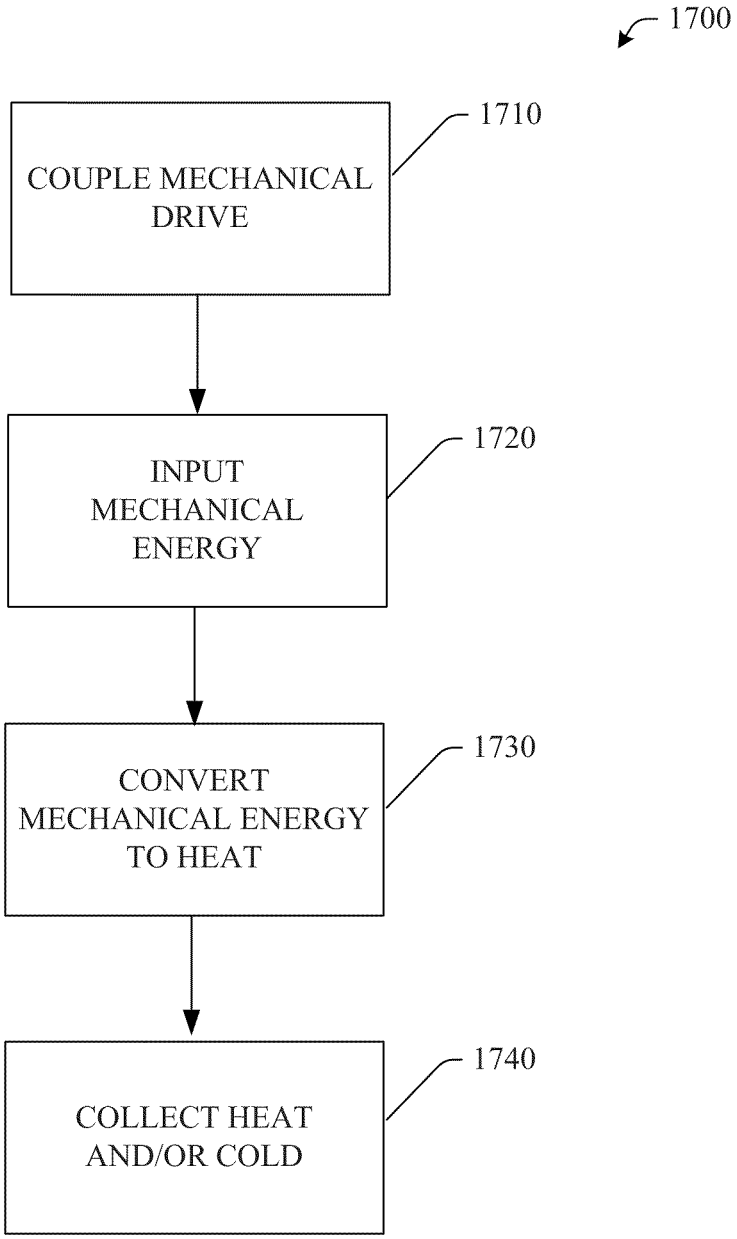
FIG. 17 illustrates a methodology for employing an engine configuration as a heat pump, in accordance with an aspect.

FIG. 17, presents methodology 1700 for employing an engine configuration as a heat pump. At 1710 a mechanical drive is coupled to an engine (e.g., system 100 and 200), where the mechanical dive is connected to the power take off shaft of a crankshaft (e.g., crankshaft 120 or 130). The mechanical drive can be attached by any suitable means such as a pulley (e.g., pulley 122) or a shaft (e.g., shaft 123). The mechanical drive can be any of a hand crank, foot pedals, treadmill, or the like, or can be wind powered or driven by a motor or engine, and the like.

At 1720 mechanical energy, via the mechanical drive and the crankshaft, is input into the engine from the external mechanical drive. In response to the mechanical energy, the crankshafts are rotated. At 1730 rotation of the crankshafts causes connect ing rods (e.g., connecting rods 110A-B and pistons 105A-B) to undergo reciprocating motion in their respective assemblies (e.g., cylinders 100A-D). Owing to the phase relationship between respective piston assemblies (e.g., piston assemblies A and B, and piston assemblies C and D) a hot workspace is created owing to compression of a working gas and a cold workspace is created owing to expansion of the working gas. Effectively, a temperature differential is created between the respective piston assemblies.

At 1740 the hot workspace and cold workspace temperatures can be utilized in a plurality of ways. The hot workspace can be used to boil water, cooking provide a heat source, etc., while the cold side can be wed facilitate condensation of water from the atmosphere, provide a cold source, etc.

The various aspects provided herein improve over existing systems in a number of ways, various improvements, etc., are presented as follows. In one aspect, configuring single or multiple pairs of hot and cold side cylinders (e.g., piston assemblies A and B or piston assemblies C and D) axially opposed to each other, in axial alignment, provides an optimal, straight-line flow path where the flow path has the full diameter of the cylinder bores, maximizing free flow of the working gas between the hot and cold working spaces through the regenerator(s) 155, heater(s) 160, and cooler(s) 165, for maximum engine efficiency and power output.

In another aspect, hot and cold working spaces that are as close as possible to each other provide the shortest possible straight-line flow path and minimize the amount of dead space or working space not swept by the pistons 105 A-D, maximizing engine efficiency and power output.

In a further aspect, utilizing thermally insulating tubes, spacers or bulkheads to mount the regenerator(s) 155, such that the regenerator(s) 155 are sandwiched between opposing hot and cold side cylinder pairs (e.g., piston assemblies A and B or piston assemblies C and D) allow the distance between the hot and cold side working spaces to be adjusted to accommodate any regenerator thickness, allowing the diameter, thickness, density and material composition of the regenerator(s) 155 to be altered, to find an ideal balance between dead space, the free flow of the working the heat storage capacity and heat transfer area of the regenerator(s) 155, for maximum engine efficiency and power output.

In another aspect, the use of thermally insulating tubes, spacers or bulkheads to mount the regenerator(s) 155, such that the regenerators are sandwiched between the opposing hot and cold side cylinder pairs (e.g., piston assemblies A and B or piston assemblies C and D), allow a wide temperature differential across the thickness of the regenerator(s) 155, maximizing regenerator effectiveness and efficiency for maximum engine efficiency and power output.

In another aspect, regenerator(s) 155 can be made with constant porosity or by using thermally insulating washers, spacers, O-rings or gaps between layers of the stack of woven wire and/or perforated metal screens used to construct the regenerator(s) 155, allow a wide temperature differential across the thickness of the regenerator(s) 155, maximizing regenerator effectiveness and efficiency for maximum engine efficiency and power output.

In another aspect, regenerator mounts that have an inside diameter larger than that of cylinders 100A-D, so that the thermally insulating adhesive material that is used to seal the edges of the regenerator(s) 155 and fix them in place, does not interfere with the free flow of the working gas, for maximum engine efficiency and power output.

In another aspect, self-lubricating materials that can operate at both high and low temperatures can be utilized e.g., pistons 105A-D constructed from graphite. facilitating operation of one or more of the disclosed aspects at temperatures high enough to maximize power and efficiency potential. Self-lubricating materials negate the use of liquid lubricants which can contaminate the working gas and when heated, could result in harmful carbon deposits that could clog the regenerators and/or damage the pistons and cylinders as such carbon particles travel throughout the working maces of the engine and/or damage the bearing surfaces of the crankshafts, connecting rods and/or wrist pins.

In another aspect, an engine configuration can be both scalable and stackable, allowing the engine or engines to take full advantage of almost any available heat source and a flowing the engine to meet almost any required power output.

In another aspect, the use of an axially opposed preferred cylinder configuration wherein single or multiple pairs of hot and cold side cylinders are axially opposed to each other, in axial alignment, with the crankshafts at opposite ends of the cylinder pairs and with each crankshaft or set of crankshafts being supported by and/or housed in separate hot and cold side crankcases, eliminating the heat path that the crankcase normally provides between the hot and cold working spaces, for the best possible thermal isolation of the hot and cold sides of the en one, maximizing engine efficiency and power output;

In another aspect, the use of separate hot and cold side crankcases, allowing the entire cold side of the engine to be air and/or water cooled and/or insulated, while allo wing the entire hot side of the engine to be heated or warmed and/or insulated, minimizing parasitic heat loss from the working spaces and maximizing the temperature differential between the hot and cold side working spaces, maximizing engine efficiency and power output;

In another aspect, the use of separate crankshafts, connecting rods, piston assemblies, etc., for each of the hot and cold sides, eliminating the heat path that these components normally provide between the hot and cold working spaces, for the best possible thermal isolation of the hot and cold sides of the engine, maximizing engine efficiency and power output;

In another aspect, the use of parts and materials that are poor thermal conductors, to connect and thermally isolate the opposing hot and cold side cylinder pairs, crankcases and crank shafts, for the best possible thermal isolation of the hot and cold sides of the engine, maximizing engine efficiency and power output;

In another aspect, the elimination of crankcase pressure spikes by timing the throws of the crankshafts to maintain a constant crankcase volume, wherein if two pairs of cylinders are used, the two throws of each crankshaft would be made to be one hundred and eighty degrees (180°) out of phase, or if four pairs of cylinders are used, the throws of each crankshaft could be made either ninety (90°) or one hundred and eighty (180°) out of phase, or if three pairs of cylinders are used, the throws of each crankshaft would be made one hundred and twenty (120°) out of phase, and so on, eliminating crankcase pressure spikes caused by variations in crankcase volume, allowing an engine configuration to be pressurized to the full capacity of the seals and structures used to contain the working is inside the engine, for maximum engine efficiency and power output;

In another aspect, the use of an external drive system to connect the hot and cold side crankshafts, which allows infinite and precise adjustment to the timing or phase relation ship of the separate crankshafts, allowing the engine to be optimized for maximum efficiency and power output at a wide variety of operating temperatures, loads and speeds, and In another aspect, the use of an external drive system to connect the hot and cold side crankshafts in a way that allows rapid and precise changes in engine speed and power output, without loss of engine pressure or temperature, by altering the timing or phase relationship of the separate hot and cold side crankshafts, within a set range of motion, allo wing the engine to serve in a much broader range of the applications than constant-speed or slow acting variable-speed engines and also allowing the engine to rotate freely or act as a compression brake for the rotating load;

In another aspect, when driven by a motor, engine, foot pedals, hand crank, water wheel, wind mill, etc., the various engine configurations presented herein can act as a heat pump that provides a number of improvements over other kinematic Stirling cycle heat pumps in a number of non-limiting aspects, such aspects include the following:

A configuration, wherein pairs of hot and cold side cylinders are axially opposed to each other, in axial alignment, with separate hot and cold side crank shafts at opposite ends of the cylinder pairs, supported and/or housed in separate hot and cold side crankcases, using separate connecting rods, piston assemblies, etc., for each of the hot and cold sides, with said crankcases, crank shafts and cylinders being connected by thermally insulating materials for maximum thermal isolation of the hot and cold sides, maximizing heat pump efficiency;

An optimal straight-line flow path for the working gas, the full diameter of the cylinder bores, for maximum heat pump efficiency;

Hot and cold working spaces that are as close as possible to each other, minimizing dead space and providing the shortest possible flow path for the working gas, for maximum heat pump efficiency;

An easily altered distance between the working spaces, where the amount of de ad space is composed of the porosity of the regenerator(s) and a snail piston-to-regenerator clearance, so that any regenerator thickness can be accommodated, allowing the regenerator(s) to be optimized for maximum heat pump efficiency in a wide variety of operating condition.

The use of thermally insulating tubes, spacers or bulkheads to mount the regenerators, so that the regenerators are sandwiched between opposing hot and cold sick cylinder pairs, allowing the distance between the hot and cold side working spaces to be easily altered, allo wing the diameter, thickness, density and material composition of the regenerators to be altered, to find the ideal balance between dead space, the free flow of the working gas and the heat storage capacity and heat transfer area of the regenerators, for maximum heat pump efficiency;

The use of thermally insulating tubes, spacers or bulkheads to mount the regenerators, so that the regenerators are sandwiched between the opposing hot and cold side cylinder pairs, allowing a wide temperature differential across the thickness of the regenerators, maximizing regenerator effectiveness and efficiency for maximum heat pump efficiency;

Regenerators that can be made using thermally insulating washers, spacers, O-rings or gaps between layers of the stack of woven wire and/or perforated metal screens used to construct them, allowing a wide temperature differential across their thickness, maximizing regenerator effectiveness and efficiency for maximum heat pump efficiency;

A constant crankcase volume when two or more cylinder pairs are used and the throws of the crankshafts are properly timed, allowing the heat pump to be pressurized to the full capacity of the seals and structures used to contain the working gas, for maximum efficiency;

Self-lubricating materials that can operate at both high and low temperatures;

A design that is both scalable and stackable, to meet almost any hot or cold temperature output requirements;

An external dive system that allows precise adjustment of the phase relationship or timing of the separate hot and cold side crank shaft allowing said timing or phase relationship to be optimized for maximum heat pump efficiency under a wide variety of operating conditions. An external drive system that allows rapid and precise changes in the timing or phase relationship of the separate hot and cold sick crankshafts and their pistons, during operation, for rapid and precise temperature control, and An external dive system that provides a simple and effective method of defrosting by reversal of the direction in which heat is pumped by altering crankshaft/piston timing.

One or more engine configurations presented herein facilitates a wide range of applications and utility of one or more disclosed aspects. The various configurations presented herein can be employed in a variety of applications including trailer-mounted systems could provide toilet facilities, trash disposal, power, heat for cooking and drinking water, in disaster areas, refugee camps and at concerts and other public events. Septic tank mounted systems could make use of all organic wastes in homes, factories and commercial buildings everywhere. Mobile systems can end high way and airport noise pollution. Solar-powered, geothermal and waste heat systems can help end global climate change by drastically reducing the demand for fossil fuels.

The methods, devices, systems, inventions, improvements and applications described and/or illustrated herein may be used made, modified and/or applied in many ways and/or in many other situations and/or applications. The specifications, illustrations and description contained herein are intended to provide clear examples of possible construct ion methods, us and/or applications of the invention and are not exhaustive or intended to limit the many possible applications or versions of the engine and heat pump configurations presented herein, or its/their associated or component parts or systems, in any way. Many variations and modifications will be apparent to those skilled in the various mechanical and physical arts. All such variations and modifications are intended to be within the scope of the present invention.

What is claimed is:

1. A system comprising:

a first cylinder having an internal hot working space and a second cylinder having an internal cold working space, the first cylinder and the second cylinder are axially aligned;

the first cylinder further comprising:

a first piston located inside the first cylinder and reciprocates along a length of the first cylinder;

the second cylinder further comprising:

a second piston located inside the second cylinder and reciprocates along a length of the second cylinder, wherein the first piston is axially opposed to the second piston;

a regenerator located between the first cylinder and the second cylinder separating the first cylinder hot working space and the second cylinder cold working space;

a working gas which is transferred between the hot working space and the cold working space in accordance with the reciprocating movement of the first piston and the second piston;

a first connecting rod connecting the first piston to a first crankshaft, the first crankshaft having a first timing pulley located thereon;

a second connecting rod connecting the second piston to a second crank shaft, the second crankshaft having a second timing pulley located thereon, wherein the first crankshaft and the second crankshaft are respectively located at the ends of the first cylinder and second cylinder not separated by the regenerator;

a timing belt connecting the first timing pulley to the second timing pulley;

a first idler pulley and a second idler pulley in contact with the timing belt at a position between the first timing pulley and the second timing pulley, wherein the first pulley and the second pulley are mounted on a linear slide, the position of the first pulley and second pulley are slidably adjusted perpendicularly to one side or the other side of a centerline drawn between the end of the first crankshaft and the end of the second crankshaft thereby altering the length of the timing belt that is above or below the centerline to facilitate adjustment of axial rotation of the first crankshaft and rotation of the second crankshaft to adjust a timing relationship between rotation of the first crankshaft and the second crankshaft and thereby control the speed with which the first piston and second piston reciprocate, wherein the respective position of the first idler pulley and second idler pulley are slidably adjusted during reciprocation of the first piston and the second piston.

2. The system of claim 1, further comprising a heating component located between the regenerator and the first cylinder, and a cooling component located between the regenerator and the second cylinder.

3. The system of claim 2, wherein an operating surface of the regenerator, a bore of the heating component, a bore of the cooling component, the bore diameter of the first cylinder and the bore diameter of the second cylinder have the same internal diameter.

4. The system of claim 1, wherein the first timing pulley is a toothed pulley and the second timing pulley is a toothed pulley.

5. The system of claim 4, wherein the timing belt is a toothed timing belt, wherein the teeth of the toothed timing belt fit the teeth of the first timing pulley and the second timing pulley.

6. The system of claim 1, wherein the position of the first idler pulley and the position of the second idler pulley is a fixed distance apart on the linear slide.

7. The system of claim 1, wherein the distance between the position of the first idler pulley and the position of the second idler pulley on the linear slide is adjustable.

8. The system of claim 1, further comprising a power take off pulley connected to the first crankshaft and configured to rotate in unison with the first crankshaft to facilitate generation of mechanical energy by the system.

9. The system of claim 8, further comprising a drive belt connected to the power take off pulley to facilitate transfer of the mechanical energy to a remote system.

10. The system of claim 1, further comprising at least one of a heating block located between the first cylinder and the regenerator or a cooling block located between the second cylinder and the regenerator.

11. The system of claim 1, wherein the timing relationship between rotation of the first crankshaft and the second crankshaft relates to a 90° phase relationship between rotation of the first crankshaft and the second crankshaft.

12. The system of claim 1, further comprising an electric linear motion device configured to move the linear slide to a position to facilitate positioning of at least one of the first pulley or the second pulley with respect to the centerline drawn between the end of the first crankshaft and the end of the second crankshaft.

13. The system of claim 12, further comprising a processor configured to control operation of the electric linear motion device.

14. The system of claim 1, further comprising a third cylinder having an internal hot working space, a third piston located inside the third cylinder and reciprocates along a length of the third cylinder, a third connecting rod connecting the third piston to the first crankshaft;

and a fourth cylinder having an internal cold working space, a fourth piston located inside the fourth cylinder and reciprocates along a length of the fourth cylinder, a fourth connecting rod connecting the fourth piston to the second crank shaft, wherein the third piston is axially aligned and axially opposed to the fourth piston;

a regenerator located between the third cylinder and the fourth cylinder separating the third cylinder hot working space and the fourth cylinder cold working space; and a working gas which is transferred between the hot working space of the third cylinder and the working space of the fourth cylinder in accordance with the reciprocating movement of the third piston and the fourth piston, wherein a throw of the first piston and second piston pairing is 180° degrees out of phase with a throw of the third piston and fourth piston pairing thereby maintaining a constant crankcase volume to facilitate elimination of a crankcase pressure spike.

15. A method for adjusting the reciprocating frequency of a stirling engine, comprising:

controlling the reciprocating frequency of at least one pair of pistons, a first piston in the at least one pair of pistons reciprocating along a length of a first cylinder operating as the hot side of the sterling engine and a second piston in the at least one pair of pistons reciprocating along a length of a second cylinder operating as the cold side of the sterling engine, wherein the controlling being performed by adjusting a working length of a timing belt connecting a first timing pulley connecting via a first crankshaft and a first connecting rod to the first piston and a second timing pulley connecting via a second crankshaft and a second connecting rod to the second piston;

adjusting the working length of the timing belt above or below a centerline drawn between the first crankshaft and the second crankshaft by slidably adjusting a position of a first idler pulley and a second idler pulley relative to the centerline, the first idler pulley and the second idler pulley are fixed to a slide;

applying at least one of heat to the hot side cylinder or cooling to the cold side cylinder facilitating reciprocating motion of the first piston and the second piston, causing, via the respective the first crankshaft and the first connecting rod and the second crankshaft and the second connecting rod, rotary motion of the first timing pulley and rotary motion of the second timing pulley, wherein the rotary motion of the first timing pulley and second timing pulley are initially a clockwise direction; and performing one of:

moving the slide in a direction upwardly perpendicular to the centerline facilitating an initial slowing of the stirling engine, and further moving the slide resulting in compression braking of the stirling engine; or moving the slide in a direction downwardly perpendicular to the centerline facilitating an initial slowing of the stirling engine, and further moving the slide resulting in coasting of the stirling Engine, wherein the respective moving of the slide in the upwardly perpendicular direction and in the downwardly perpendicular direction causing an adjusting of a phase relation between the first piston and the second piston.

16. The method of claim 15, further comprising transferring mechanical energy being generated by the stirling engine by a power take off pulley connecting the first crankshaft and a remote system, via a drive belt connected to the power take off pulley.

17. The method of claim 15, further comprising configuring an initial at-rest position of the first piston relative to the second piston with a 90° phase relationship between rotation of the first crankshaft and the second crankshaft.

18. A computer-implemented method for adjusting the reciprocating frequency of a stirling engine, the method comprising:

controlling, by a system including a processor, the reciprocating frequency of at least one pair of pistons, a first piston in the at least one pair of pistons reciprocating along a length of a first cylinder operating as the hot side of the sterling engine and a second piston in the at least one pair of pistons reciprocating along a length of a second cylinder operating as the cold side of the sterling engine, wherein the controlling being performed by adjusting a working length of a timing belt connecting a first timing pulley connecting via a first crankshaft and a first connecting rod to the first piston and a second timing pulley connecting via a second crankshaft and a second connecting rod to the second piston;

adjusting the working length of the timing belt above or below a centerline drawn between the first crankshaft and the second crankshaft by slidably adjusting a position of a first idler pulley and a second idler pulley relative to the centerline, the first idler pulley and the second idler pulley are fixed to a slide;

applying at least one of heat to the hot side cylinder or cooling to the cold side cylinder facilitating reciprocating motion of the first piston and the second piston, causing, via the respective the first crankshaft and the first connecting rod and the second crankshaft and the second connecting rod, rotary motion of the first timing pulley and rotary motion of the second timing pulley, wherein the rotary motion of the first timing pulley and second timing pulley are initially a clockwise direction; and performing one of:

moving the slide in a direction upwardly perpendicular to the centerline facilitating an initial slowing of the stirling engine, and further moving the slide resulting in compression braking of the stirling engine; or moving the slide in a direction downwardly perpendicular to the centerline facilitating an initial slowing of the stirling engine, and further moving the slide resulting in coasting of the stirling Engine, wherein the respective moving of the slide in the upwardly perpendicular direction and in the downwardly perpendicular direction causing an adjusting of a phase relation between the first piston and the second piston.

19. The method of claim 18, further comprising transferring mechanical energy being generated by the stirling engine by a power take off pulley connecting the first crankshaft and a remote system, via a drive belt connected to the power take off pulley.

20. The method of claim 18, further comprising configuring an initial at-rest position of the first piston relative to the second piston with a 90° phase relationship between rotation of the first crankshaft and the second crankshaft.

* * * * *